US011793708B2

(12) United States Patent
Quan

(10) Patent No.: US 11,793,708 B2
(45) Date of Patent: Oct. 24, 2023

(54) PHYSIOTHERAPY INSTRUMENT FOR HUMAN BODY FACET JOINT INFLAMMATION

(71) Applicant: Chengxian Quan, Yangzhou (CN)

(72) Inventor: Chengxian Quan, Yangzhou (CN)

(73) Assignee: Chengxian Quan, Yangzhou (CN)

( * ) Notice: Subject to any disclaimer, the term of this patent is extended or adjusted under 35 U.S.C. 154(b) by 357 days.

(21) Appl. No.: 16/618,382

(22) PCT Filed: May 29, 2018

(86) PCT No.: PCT/CN2018/088775
§ 371 (c)(1),
(2) Date: Dec. 1, 2019

(87) PCT Pub. No.: WO2018/233454
PCT Pub. Date: Dec. 27, 2018

(65) Prior Publication Data

US 2021/0137774 A1 May 13, 2021

(30) Foreign Application Priority Data

Jun. 19, 2017 (CN) ..... 201710464653.9
Jun. 19, 2017 (CN) ..... 201720712001.8
(Continued)

(51) Int. Cl.
*A61H 9/00* (2006.01)

(52) U.S. Cl.
CPC ..... *A61H 9/0057* (2013.01); *A61H 2201/164* (2013.01); *A61H 2205/102* (2013.01)

(58) Field of Classification Search
CPC ..... A61H 9/0057; A61H 9/0078; A61H 2201/164; A61H 2201/0192;
(Continued)

(56) References Cited

U.S. PATENT DOCUMENTS 59,388 A * 11/1866 Hadfield ..... A61H 9/005 4/535
2,113,253 A * 4/1938 Gray ..... A61H 9/005 128/DIG. 20
(Continued)

FOREIGN PATENT DOCUMENTS

CN 2096354 U 2/1992
CN 2271369 Y 12/1997
(Continued)

*Primary Examiner* — Justine R Yu
*Assistant Examiner* — Kelsey E Baller
(74) *Attorney, Agent, or Firm* — ANOVA LAW GROUP, PLLC

(57) ABSTRACT

A physiotherapy instrument for human body facet joint inflammation includes a rigid therapy cavity and a negative pressure generation control system. The rigid therapy cavity is provided with at least one opening for a limb to enter and leave. The rigid therapy cavity is connected to the negative pressure generation control system by an air passage. The rigid therapy cavity is L-shaped, to allow a partial thigh above a knee of a limb and a partial or entire shank below the knee to be put in after bending, and allow a partial arm above an elbow of a limb and a partial or entire forearm below the elbow to be put in after bending. The L-shaped therapy cavity is composed of several parts fitted with each other to form a whole. The opening of the rigid therapy cavity and the limb are fixed by a sealed connecting component.

17 Claims, 18 Drawing Sheets

(30) Foreign Application Priority Data

| | | |
|---|---|---|
| Jul. 28, 2017 | (CN) | 201710628998.3 |
| Jul. 28, 2017 | (CN) | 201720928697.8 |
| Nov. 9, 2017 | (CN) | 201711098569.6 |
| Nov. 9, 2017 | (CN) | 201721487327.1 |
| Nov. 29, 2017 | (CN) | 201721627415.7 |
| Apr. 12, 2018 | (CN) | 201810323202.8 |
| Apr. 12, 2018 | (CN) | 201820511741.X |
| Apr. 26, 2018 | (CN) | 201810386471.9 |
| Apr. 26, 2018 | (CN) | 201820608838.2 |

(58) Field of Classification Search

CPC ..... A61H 2201/169; A61H 2201/0157; A61H 2201/1688; A61H 2201/1238; A61H 2201/1635; A61H 2201/5056; A61H 2201/1409; A61H 2205/102; A61H 2205/06; A61H 2205/106; A61H 2203/0431; A61H 2203/045; A61H 2209/00

USPC ..... 601/11

See application file for complete search history.

(56) References Cited

U.S. PATENT DOCUMENTS

| | | | | | |
|---|---|---|---|---|---|
| 3,403,673 | A * | 10/1968 | Macleod | A61F 5/34 | 600/16 |
| 3,563,234 | A * | 2/1971 | Umstead | A61L 15/12 | 602/8 |
| 3,859,989 | A * | 1/1975 | Spielberg | A61H 9/005 | 601/11 |
| 5,683,438 | A * | 11/1997 | Grahn | A61F 7/02 | 607/104 |
| 6,168,611 | B1 * | 1/2001 | Rizvi | A61B 17/06 | 606/222 |
| 7,833,179 | B2 * | 11/2010 | Filtvedt | A61H 1/008 | 601/151 |
| 8,287,474 | B1 * | 10/2012 | Koenig | A61K 31/557 | 601/149 |
| 2003/0191420 | A1 * | 10/2003 | Kuiper | A61F 5/012 | 601/151 |
| 2009/0177184 | A1 * | 7/2009 | Christensen | A61H 9/0057 | 604/113 |
| 2010/0305497 | A1 * | 12/2010 | Tanaka | A61M 35/30 | 604/23 |
| 2011/0000484 | A1 | 1/2011 | Melsheimer | | |
| 2011/0257589 | A1 * | 10/2011 | Nakamura | A61K 33/00 | 604/24 |
| 2013/0041295 | A1 | 2/2013 | Koenig et al. | | |
| 2015/0065931 | A1 * | 3/2015 | Alnabulsi | A61B 5/349 | 601/152 |
| 2016/0136404 | A1 * | 5/2016 | Moore | A61M 35/10 | 604/290 |

FOREIGN PATENT DOCUMENTS

| | | | | |
|---|---|---|---|---|
| CN | 2276798 | Y | 3/1998 | |
| CN | 3133917 | | 1/2000 | |
| CN | 104197130 | A * | 12/2014 | F16L 23/02 |
| CN | 204411230 | U | 6/2015 | |
| CN | 204744885 | U | 11/2015 | |
| CN | 105919780 | A | 9/2016 | |
| CN | 206044947 | U | 3/2017 | |
| CN | 106691802 | A | 5/2017 | |
| CN | 206214377 | U | 6/2017 | |
| CN | 107320306 | A | 11/2017 | |
| CN | 108066116 | A | 5/2018 | |
| CN | 209059785 | U | 7/2019 | |
| CN | 209392348 | U | 9/2019 | |

* cited by examiner

PHYSIOTHERAPY INSTRUMENT FOR HUMAN BODY FACET JOINT INFLAMMATION

CROSS REFERENCE TO THE RELATED APPLICATIONS

This application is the national phase entry of International Application No. PCT/CN2018/088775, filed on May 29, 2018, which based upon and claimed priority to Chinese Patent Application No. 201710464653.9, filed on Jun. 19, 2017, Chinese Patent Application No. 201720712001.8, filed on Jun. 19, 2017, Chinese Patent Application No. 201710628998.3, filed on Jul. 28, 2017, Chinese Patent Application No. 201720928697.8, filed on Jul. 28, 2017, Chinese Patent Application No. 201711098569.6, filed on Nov. 9, 2017, Chinese Patent Application No. 201721487327.1, filed on Nov. 9, 2017, Chinese Patent Application No. 201721627415.7, filed on Nov. 29, 2017, Chinese Patent Application No. 201810323202.8, filed on Apr. 12, 2018, Chinese Patent Application No. 201820511741.X, filed on Apr. 12, 2018, Chinese Patent Application No. 201810386471.9, filed on Apr. 26, 2018, Chinese Patent Application No. 201820608838.2, filed on Apr. 26, 2018, the entire contents of which are incorporated herein by reference.

TECHNICAL FIELD

The present invention relates to the technical field of medical therapy equipment, and in particular, to use of a negative pressure to enhance blood circulation of a limb for therapy of human body facet joint inflammation and diabetic feet.

BACKGROUND

China has created cupping therapy using a principle of negative pressure since ancient times. NASA and the Fourth Military Medical University have also used negative pressure capsules and negative pressure pants for training and rehabilitation of astronauts and treatment of various vascular diseases. However, negative pressure therapy rehabilitation equipment has the following defects: 1. The equipment is cumbersome, an excessive friction of a seal between a therapy cavity and a limb may cause an unbearable pain in the skin of the limb in a negative pressure therapy, and the therapy adherence cannot be achieved; or there may be catastrophic side effects such as bleeding caused by crushing the therapy cavity by a plantar ulcer surface. 2. The equipment is not easily sealed and involves complex operations. Some sealing methods, such as airbag sealing, cause severe radial compression to blood vessels of a limb, thus obstructing the blood circulation of the limb and causing an unbearable pain; it runs counter to the purpose of the equipment and has great side effects. 3. The equipment is costly and not portable and cannot be used at home. These are also the main reasons why such equipment has not entered medical institutions and families on a large scale to benefit the society.

SUMMARY

An objective of the present invention is to overcome the deficiencies of the prior art and to provide a lightweight physiotherapy instrument for human body facet joint inflammation, which has a good therapeutic effect.

The objective of the present invention is achieved in the following manner: a physiotherapy instrument for human body facet joint inflammation includes a rigid therapy cavity and a negative pressure generation control system, where the therapy cavity is provided with at least one opening for a limb to enter and leave; the therapy cavity is connected to the negative pressure generation control system by means of an air passage; the therapy cavity is L-shaped, to allow a partial thigh above a knee of a limp and a partial or entire shank below the knee to be put in after bending, and allow a partial arm above an elbow of a limb and a partial or entire forearm below the elbow are allowed to be put in after bending; the L-shaped therapy cavity is composed of several parts fitted with each other to form a whole; and the opening of the therapy cavity and the limb are fixed by means of a sealed connecting component.

In the present invention, a conventional straight cylindrical therapy cavity is structurally changed into the L-shaped therapy cavity, so that upper and lower parts of a joint are put into the therapy cavity at the same time after a knee joint or an elbow joint of the limb bends, thus fundamentally changing the condition of mechanical instability between the straight cylindrical therapy cavity and the limb under a negative pressure. A frictional force between the limb and the therapy cavity under the negative pressure is converted into a pressure applied by the knee or the elbow joint on a cavity wall (turning), and the therapy cavity is designed to be L-shaped (the design allows the knee or the elbow to be in contact with the turning of the therapy cavity during bending to transmit a mutual pressure), so that the direction of an interaction force between the limb and the therapy cavity is changed, thereby completely avoiding a relative motion caused by the negative pressure between the straight cylindrical therapy cavity of the prior art and the limb. The design may fundamentally reduce the weight of the therapy cavity while maintaining the mechanical stability of the therapy cavity under the negative pressure. The relative motion between the therapy cavity and the limb no longer occurs in a negative pressure therapy, and mechanical crush on plantar ulcer of diabetic feet in the negative pressure therapy is also eliminated to prevent bleeding caused by ulcer crush. This is a revolutionary change as significant as developing a straight telescope into a periscope, developing a straight-tube gun into a bendable shooting gun, changing a flight deck of an aircraft carrier from a deck with an elevation for ski jump take-off to a flat plane for catapult-assisted take-off, and modifying the positions of needle holes of needles of a sewing machine from a tail to a head. Details are as follows:

For example, a leg is treated by therapy cavity equipment with one open end. In the prior art, a straight cylindrical therapy cavity is adopted, that is, a limb (thigh and shank) is substantially straight in a therapy. When the limb (e.g., the leg, including a foot) enters the therapy cavity, since the foot is usually greater than the leg in diameter, the diameter of the therapy cavity must be greater than the length of the foot, resulting in a large volume of the therapy cavity. Even so, it is not easy to stretch into the therapy cavity. Especially for a diabetic foot patient, it is more difficult to stretch into the therapy cavity. After the foot of the patient enters the therapy cavity finally, if a sole of the foot is in physical contact with a bottom of the therapy cavity, under the negative pressure, there will be mechanical periodic crush (F=PS) between the sole of the foot and the bottom of the therapy cavity. The magnitude of the acting force is directly proportional to a cross sectional area S of the thigh at a leg seal and the negative pressure. According to an intermittent negative pressure (−7 KPa to −10 KPa) in a conventional therapy and the cross sectional area of the leg of 200 $cm^2$, the pressure F is calculated to be about 15 Kg to 20 Kg. The mechanical periodic crush will cause the diabetic foot patient to have ulcer bleeding, and the consequence will be catastrophic. If the sole of the foot is not in contact with the bottom of the therapy cavity (since the equipment is usually suitable for most people with different leg lengths, the sole of the foot is not in contact with the bottom of the therapy cavity generally), the therapy cavity is only in contact with the skin of the thigh at the thigh seal to generate a frictional force. The frictional force F is equivalent to an original crushing force between the sole of the foot and the bottom of the therapy cavity. According to the above calculation, F is about 15 Kg to 20 Kg. The long-term frictional force on the skin of the thigh will cause an unbearable pain in the skin of the thigh, and the therapy adherence cannot be achieved.

The above is not a fundamental problem. The therapy cavity and the limb must be relatively stable during a therapy. The weight of a human body is generally 50 Kg or more, and a frictional force between the human body sitting or lying and a contact surface will be greater than 20 Kg. However, since a frictional coefficient between the therapy cavity and the ground is small, a frictional force greater than 20 Kg should be generated to maintain relative stability with the limb in a negative pressure therapy. Therefore, it is necessary to increase the frictional force with the ground by increasing the weight of the therapy cavity, thus fixing the therapy cavity. To generate a maximum static frictional force greater than 20 Kg with the ground to maintain stability, the weight of the therapy cavity usually needs to be 50 Kg or more, which is the lowest weight of all current straight cylindrical therapy cavity equipment. The weight of some therapy cavities such as a Vacusport equipment therapy cavity is even more than 100 Kg, so the equipment is completely non-portable or cannot be used at home. For the above reasons, even if the weight is not considered, the resultant side effect of an unbearable limb pain caused by an excessive frictional force with the skin contact surface of the limb at the seal is fatal, and the equipment is difficult to promote. However, if the therapy cavity only acts on a partial shank below the knee, the affected blood supply range is limited and the therapeutic effect is not good due to a small acting area, and the side effect of bleeding caused by crushing the soles of the diabetic feet in the negative pressure therapy cannot be eliminated. If there is an ulcer in the shank, it will not be used, and it will not be promoted in a large area or used at home.

For the therapy cavity with two open ends, the mechanical principle is the same as that of the therapy cavity with one open end. When the straight cylindrical therapy cavity is adopted, since for a limb (e.g., a thigh and a shank), the cross sectional area of the thigh is greater than that of the shank by about 100 $cm^2$, the therapy cavity will move toward the base of the thigh from the shank in the negative pressure therapy. The pressure difference is about 7 Kg to 10 Kg. Just like the therapy cavity with one open end, the problem is solved only by increasing the frictional force with the contact surface or the ground by increasing the weight of the therapy cavity, which may also cause the equipment to be cumbersome and cause great side effects. In the early 1990s, China had relevant patent applications, namely: No. 96204856.9 titled Vacuum Negative Pressure Massage Therapy Instrument, and No. 96218196.X titled Vacuum Therapy Instrument, both of which were applied by Professor Xiaolin Tong of the China-Japan Friendship Hospital. The second invention was applied because the inventor found that the therapy cavity of the first invention is mechanically instable. But the improved second invention is also wrong and does not solve the fundamental problem, and therefore the two inventions are not practical and cannot benefit the society.

Of course, in addition to the mechanical problems and various side effects, another reason why the above equipment cannot be used and promoted in a large area is that the existing sealing technology involves complex operations and the sealing is unreliable. As mentioned above, many of the existing technologies use an airbag seal, which directly makes it difficult for a limb to enter and exit from an airbag. The airbag inflation and deflation operations are complex. Moreover, the airbag also has severe radial compression on the limb. Consequently, blood vessels are compressed, the limb pain is unbearable, and the blood circulation is blocked, which is contrary to the purpose of the equipment. The equipment cannot be promoted. This is one of the reasons why the airbag seal patent No. 91217951.1 of the Fourth Military Medical University cannot be promoted. The airbag seal is subsequently improved to a sealing sleeve seal (the sealing sleeve seal belongs to the Chinese patent No. 99327498.6). However, the above problems of mechanical instability between the therapy cavity and the limb in the negative pressure therapy and the various side effects and equipment cumbersomeness caused thereby are not resolved yet. Therefore, the equipment cannot be promoted though it has some therapeutic effects.

The fatal defects of all of the above equipment require revolutionary solutions, so that all mankind can be benefitted by such equipment.

The inventor has completely and thoroughly overcome the deficiencies of the prior art by the following methods:

1. A solution for the defects that the equipment is cumbersome, an excessive friction of a seal between the therapy cavity and the limb may cause an unbearable pain in the skin of the limb in a negative pressure therapy, and the therapy adherence cannot be achieved; or there may be catastrophic side effects such as bleeding caused by crushing the therapy cavity by a plantar ulcer surface:

The straight cylindrical therapy cavity is cumbersome because it needs to overcome a pressure difference. For this reason, the inventor designs the L-shaped therapy cavity, so that the frictional force between the limb and the therapy cavity is changed into a relative pressure between the limb and the therapy cavity wall, so that the acting direction of the force is changed. Thus, it is not necessary to increase the frictional force between the therapy cavity and the ground, so that the therapy cavity may be very lightweight, and the problem about portability is completely solved. Moreover, the frictional force at a seal between the opening of the therapy cavity and the limb is eliminated, and there is no unbearable pain in the limb in a therapy. This is a creative change. The weight of therapy equipment which is as heavy as about 100 Kg and has obvious side effects is reduced to about 1 Kg. A solid foundation is laid for the equipment to enter the mass market. It is also very important that the L-shaped design fundamentally changes the mechanical structure and changes the direction of a force in the negative pressure therapy, so that an external force acts along the thigh and is transmitted to the turning of the therapy cavity through the knee. There is no additional mechanical force on the sole of the foot, so that diabetic foot patients will not bleed due to the mechanical crushing force on the plantar ulcer caused by the negative pressure, which is also a revolutionary progress. This is totally different from the case of the straight cylindrical therapy cavity, in which the acting force is transmitted from the thigh to the shank and then to the sole of the foot, or the frictional force directly acts on the skin of the thigh seal. Such a design defect is overcome.

2. A solution for the defects that the equipment is not easily sealed and operations are complex, some sealing methods such as airbag sealing have severe radial compression on blood vessels of the limbs, thus obstructing the blood circulation of the limb and causing an unbearable pain; it runs counter to the purpose of the equipment and has great side effects; meanwhile, it is difficult to disinfect and it is prone to cross infection:

The inventor well solves this problem by using a sealing technology based on a disposable sealing bag or a winding tape. The sealing bag is relatively reliable in sealing, simple in operation, and low in cost. The sealing bag is made of an airtight polymer material and fixed to the limb only by an ordinary strap or an elastic strap to form a seal, and there are no additional requirements on elasticity or the like. A radial pressure may be eliminated as long as a movable spacer is placed between the limb and the therapy cavity opening. The movable spacer may be fixed to the therapy cavity wall to reduce a gap area between the limb and the therapy cavity opening. Then, the pressure of a sealing material on the movable spacer under the negative pressure will be borne by the therapy cavity. There is no radial pressure on the limb. Even the frictional force is greatly reduced because of the reduction of the gap area. The problem of the radial pressure and the friction between the sealing material and the skin of the limb is perfectly solved. The blood vessels are not compressed, blood circulation is not blocked, and the therapeutic effect is more remarkable. The method is a critical step for making the equipment truly practical.

3. A solution for the defect that the equipment is costly and not portable and cannot be used at home:

Since the L-shaped therapy cavity is adopted, the limb and the therapy cavity are relatively stable during the negative pressure operation, and the volume of the therapy cavity is greatly reduced. Therefore, the weight is reduced, the problems of low portability and high cost are solved, and the practicality is determined.

The inventor conducted a preliminary clinical trial of the product, which completely reached and exceeded an expected therapeutic effect, had an immediate effect on many diseases caused by poor circulation of lymphatic fluid, tissue fluid and blood, and also had an obvious rehabilitation effect on physical fitness. Although relevant healing and rehabilitation mechanisms are not completely clear, the results are obvious. In the future, the portable therapy instrument or physical rehabilitation equipment is expected to enter the vast field of sports and aerospace to achieve a good effect on physical rehabilitation of astronauts in space capsules and rapid physical rehabilitation of athletes who consume a lot of physical energy, such as football players.

For convenience of production, the L-shaped therapy cavity includes a first housing and a second housing that form an L shape; the opening of the therapy cavity for the limb to enter and leave is circular arc-shaped, and the circular arc-shaped opening is formed by fitting a semi-arc-shaped first opening on the first housing with a semi-arc-shaped second opening on the second housing; and the therapy cavity is provided with one open end or two open ends.

To ensure a sealing effect, the sealed connecting component includes an airtight winding tape for winding sealing made of a polymer material, so that air inside and air outside the therapy cavity are isolated in a negative pressure therapy.

The sealed connecting component of the present invention includes a first sealing bag with one open end, the L-shaped therapy cavity is completely sleeved in the first sealing bag, and the open end of the first sealing bag is sealed and fixed to the limb. If the therapy cavity is wrapped in a sealing bag as a whole, the sealing is extremely simple and convenient, but the appearance is slightly poor. However, the priority of the therapy equipment should be the therapeutic effect rather than the beautiful appearance. Integrated sealing based on a sealing bag is an innovative method in the field. The combination of the sealing bag and the therapy cavity is more convenient and practical. The sealing bag is made of an airtight polymer material. The sealing bag is required to be airtight instead of being elastic, and required to completely cover the therapy cavity with the open end fixedly sealed with the limb. For convenience of the connection to the negative pressure generation system, it is a common practice to provide a hole in the sealing bag or install an air nozzle to connect the therapy cavity to a negative pressure generation pipeline. The sealing bag is in conformity with configuration forms such as a common plastic packaging bag, and is composed of upper and lower layers with one open end or two open ends for covering the therapy cavity. If the therapy cavity is integrally wrapped and sealed by the sealing bag, a sealing strip between the first housing and the second housing may be removed, and the sealing is simpler and more convenient. Specifically, the first or second sealing bag may be provided with an air hole or an air nozzle. After the first or second sealing bag covers the therapy cavity, the sealing bag is connected to the air passage of the negative pressure generation system by means of the air hole or the air nozzle, and forms a seal herein. Meanwhile, the open end of the first or second sealing bag is fixedly sealed with the limb by a strap or the like, so as to generate a negative pressure during operation. For the purpose of simple and reliable operation, the therapy cavity may be provided with an air nozzle or an air hole which is butt-jointed with the air hole or the air nozzle of the first or second sealing bag and then is butt-jointed and sealed with a negative pressure generation air passage. The air passage of the negative pressure generation system may also be directly butt-jointed with the corresponding air hole or air nozzle of the therapy cavity and the negative pressure generation air passage. The other end of the air passage stretches out of the sealing bag from the inside via the open end of the first or second sealing bag, and then the open end of the sealing bag is fixed to the limb by using a strap to form a seal, so as to form a negative pressure during operation. The first or second sealing bag is not provided with an air hole or an air nozzle.

As above, the sealed connecting component includes a second sealing bag with two open ends, the L-shaped therapy cavity is completely sleeved in the second sealing bag, and the two open ends of the second sealing bag are sealed and fixed to the limb. The connection sealing method of the remaining air passage therapy cavities is the same as that described in the first sealing bag.

For convenience of the connection between the therapy cavity and the negative pressure generation control system, the first sealing bag or the second sealing bag may be provided with an air hole or an air nozzle according to different requirements. The air hole or the air nozzle is connected to the air passage of the negative pressure generation system with a seal formed at a junction, and the other end of the air passage is connected to the negative pressure generation control system. It is also possible to provide an air nozzle on the therapy cavity at the same time to facilitate the butt-jointed sealing of the air passage with the sealing bag and the therapy cavity.

The first sealing bag or the second sealing bag of the present invention is made of an airtight polymer material.

The sealed connecting component of the present invention is sealed by a sealing tape made of an elastic polymer material, and two ends of the sealing tape are connected and closed by a connecting zipper to form a sealing sleeve seal, so that air inside and air outside the therapy cavity are isolated in a negative pressure therapy. The sealing sleeve seal formed by connecting and closing the two ends by the connecting zipper may also completely replace the second sealing bag with two open ends. The sealing sleeve integrally wraps the therapy cavity during therapy. The sealing sleeve formed by connecting and closing the two ends by the connecting zipper is provided with an air hole or an air passage to be butt-jointed with the negative pressure generation air passage in a sealed manner, which is in conformity with the operating principle of the second sealing bag with two open ends.

The rigid therapy cavity of the present invention is formed by butt-jointing at least two parts fitted with each other, the therapy cavity is provided with a therapy cavity opening, and the therapy cavity opening is openable. The sealed component includes a sealing sleeve. The sealing sleeve is seamless and internally hollow, and has two open ends. The limb is allowed to enter or leave the internal hollow. One end of the sealing sleeve is connected to the limb by means of a strap, and the other end is connected to the therapy cavity opening. A method for splitting the therapy cavity from the opening thereof is adopted. During operation, the following method is adopted: the limb is wrapped by the therapy cavity composed of several parts and then the parts are butt-jointed. Then the therapy cavity is butt-jointed with the sealing sleeve sleeved on the limb in advance to form a seal. The sealing sleeve is used at each open end of the therapy cavity, and then the therapy cavity is connected to the positive-negative pressure generation control system to start working, which greatly reduces the inconvenience of an original operation and facilitates use. In order to ensure a better sealing effect, after the sealing sleeve is connected to the therapy cavity, in order to ensure, the sealing sleeve is fixed to the limb and the opening of the therapy cavity by using a fixing rope or a strap, to ensure that the sealing sleeve does not fall off during operation.

The therapy cavity of the present invention includes an upper therapy cavity and a lower therapy cavity, and a gap is formed between a lower end of the upper therapy cavity and an upper end of the lower therapy cavity. The upper therapy cavity is near a thigh or near a shoulder of an upper limb, and the lower therapy cavity is near a foot or near a hand of an upper limb. The two-segment composite therapy cavity is suitable for patients with different leg lengths (or different lower arm lengths). The two therapy cavity segments are combined into an entire therapy cavity with one open end, including a foot (or hand). As the therapy cavity bends, physical and mechanical results of limiting or not between the segments are different. For some people, such as diabetic foot patients with plantar ulcer, limiting is necessary. For some people, limiting is unnecessary. In the case without the limiting, under the negative pressure, there is room for height reduction between the therapy cavities. If the height is reduced, the bottom of the therapy cavity exerts pressure on the sole of the foot (or hand), thereby achieving the effect of physically massaging the sole of the foot (or hand), etc.

The therapy cavity of the present invention includes an upper therapy cavity and a lower therapy cavity. A lower end of the upper therapy cavity and an upper end of the lower therapy cavity are butt-jointed and partially overlapped, and overlapped portions are provided with corresponding pin holes and connected by means of a pin. Adjustment is performed based on different pin positions, so as to adapt to patients with different leg lengths (or lower arm lengths). Moreover, for some people, for example, people with plantar ulcer, limiting is necessary. If the therapy cavity at the thigh bends after limiting, the external pressure will not be directly exerted on the shank and the sole of the foot (or hand), but on the knee or the elbow. That is, the therapy cavity itself does not exert a physical pressure on the sole of the foot due to contact crushing. The sole of the foot may be suspended, that is, the sole of the foot may not be pressed. This is crucial for people with plantar ulcer; otherwise it may cause catastrophic hard-to-heal bleeding injuries to diabetic foot patients with plantar ulcer. This is one of the reasons why the straight cylindrical therapy cavity is not suitable for treating the diabetic foot patients with plantar ulcer. Therefore, in most cases, the bending therapy cavity drawn in the embodiments is more effective, and has small side effects.

The therapy cavity of the present invention includes an upper therapy cavity, an intermediate therapy cavity and a lower therapy cavity. An upper end of the intermediate therapy cavity and the upper therapy cavity are butt-jointed and partially overlapped, a lower end of the intermediate therapy cavity and the lower therapy cavity are butt-jointed and partially overlapped, and overlapped portions are provided with corresponding pin holes and connected by means of pins.

The therapy cavity of the present invention includes an upper therapy cavity and a lower therapy cavity. The upper therapy cavity and the lower therapy cavity are connected by means of two connecting frames. The two connecting frames are located on left and right sides of the therapy cavity and each include a first connecting rod and a second connecting rod. The upper therapy cavity, the first connecting rods, the second connecting rods, and the lower therapy cavity are hinged sequentially. A joint of the first connecting rod and the second connecting rod may be rotated to change an angle. The upper therapy cavity and the lower therapy cavity may change an angle by means of the connecting frames to facilitate free bending of the joint of the patient. Bending is necessary because some people have different degrees of joint bending, for example, some people are comfortable at 100 degrees while some people are comfortable at 90 degrees, the patient may move the joint from time to time during therapy without keeping a long-term fixed angle which is unbearable. Since the sealing bag is used for integrated sealing, the motion of the joint affects neither a sealing effect nor a therapeutic effect.

The rigid therapy cavity of the present invention is an integrated therapy cavity formed by one or more portions. The integrated therapy cavity is provided with one open end or two open ends, gaps or holes are provided between various components or on materials of various portions, and the integrated therapy cavity is formed by butt-jointing the various components in any manner. The integrated therapy cavity is fixed and sealed to the limb by the first sealing bag or the second sealing bag.

DETAILED DESCRIPTION OF THE EMBODIMENTS

Embodiment 1

Figure 1:
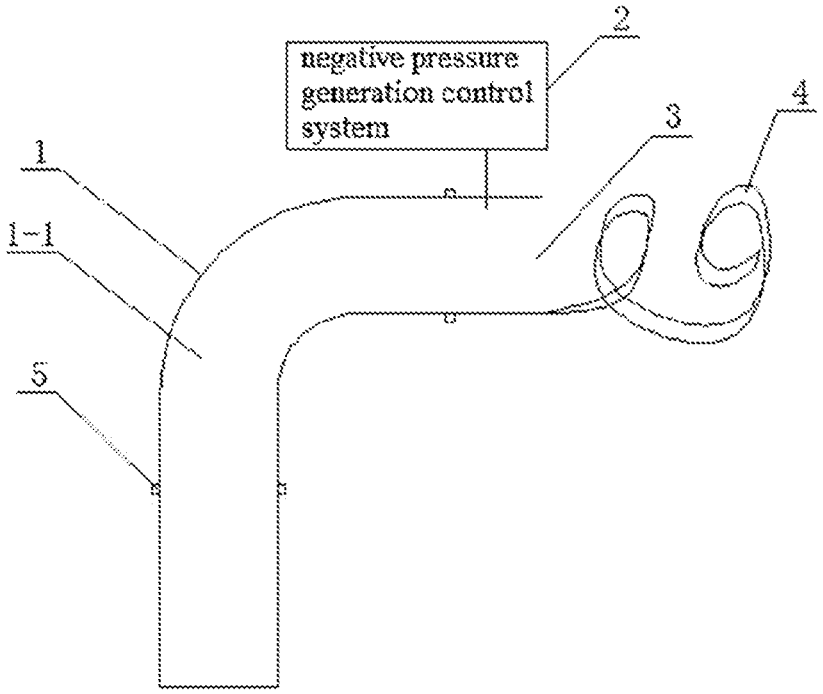
FIG. 1 shows a first schematic structural diagram of the present invention.
Figure 2:
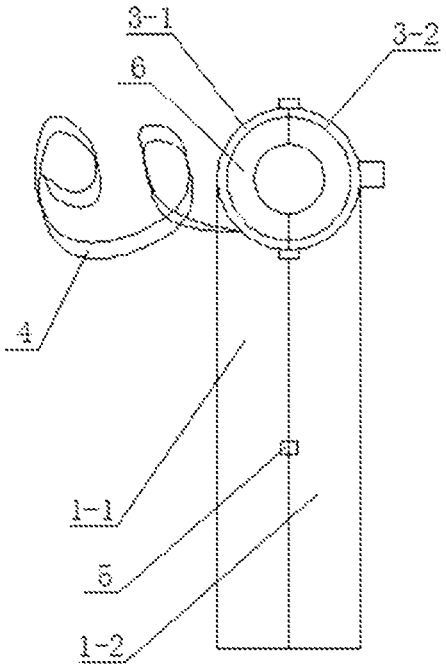
FIG. 2 shows a right view of FIG. 1 from which a negative pressure generation control system is removed.

A first physiotherapy instrument for human body facet joint inflammation is as shown in FIG. 1 and FIG. 2, and includes a rigid therapy cavity 1 and a negative pressure generation control system 2. The therapy cavity 1 is made of a transparent material and is L-shaped, to allow a partial thigh above a knee of a limb and a partial or entire shank below the knee to be put in after bending, and allow a partial arm above an elbow of a limb and a partial or entire forearm below the elbow to be put in after bending. The L-shaped therapy cavity 1 is composed of two parts fitted with each other to form a whole. The two parts are sealed by a sealing strip at a seam. The therapy cavity 1 is connected to the negative pressure generation control system 2 by means of an air passage. The therapy cavity 1 is provided with an opening 3 for the limb to enter and leave. An easy-to-remove filling block 6 for filling a gap is provided between the opening 3 of the therapy cavity 1 and the limb. The filling block 6 is made of an elastic polymer material that may be crushed and deformed by the limb. The filling block 6 isolates air inside and outside the therapy cavity to form a seal independently in a negative pressure therapy. The opening 3 of the therapy cavity 1 and the limb are wound and sealed by an airtight winding tape 4 made of a polymer material, such that air inside and air outside the therapy cavity are isolated in the negative pressure therapy, and after winding and sealing by the winding tape 4, a strap is additionally provided for fixing the winding tape.

The L-shaped therapy cavity 1 includes a first housing 1-1 and a second housing 1-2 forming an L shape. The first housing 1-1 and the second housing 1-2 are arranged left and right. The first housing 1-1 and the second housing 1-2 are fixed by a fastener 5. The first housing 1-1 and the second housing 1-2 may also be fixed by a buckle cord or the like instead of the fastener. A sealing strip is provided at a junction between the first housing 1-1 and the second housing 1-2. The opening 3 for the limb to enter and leave is circular arc-shaped, and the circular arc-shaped opening 3 is formed by fitting a semi-arc-shaped first opening 3-1 on the first housing 1-1 with a semi-arc-shaped second opening 3-2 on the second housing 1-2.

Embodiment 2

Figure 3:
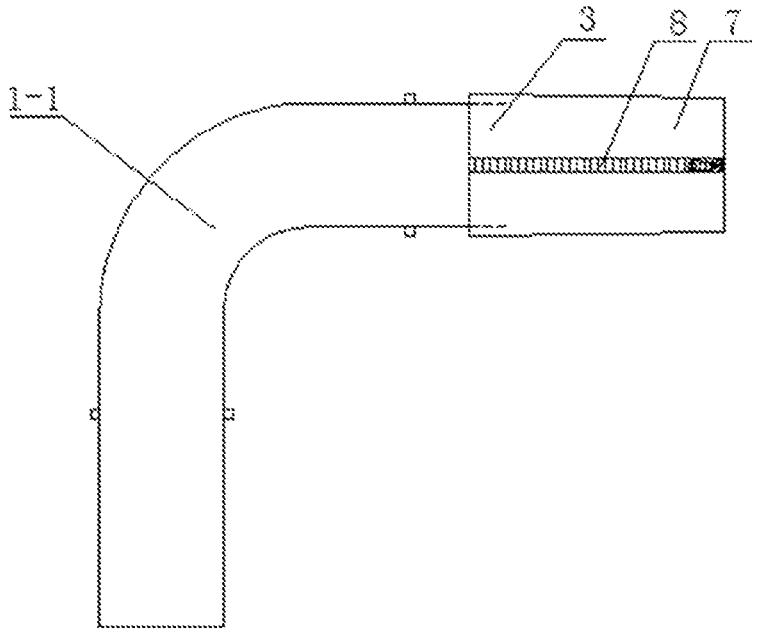
FIG. 3 shows a second schematic structural diagram of the present invention.

A second physiotherapy instrument for human body facet joint inflammation is as shown in FIG. 3. An opening 3 of a therapy cavity 1 and a limb are sealed by a sealing tape 7 made of an elastic polymer material. Two ends of the sealing tape 7 are connected and closed by a sealing zipper 8 to form a sealing sleeve seal, so that air inside and air outside the therapy cavity are isolated in a negative pressure therapy. The rest of the structure is the same as that in Embodiment 1.

Embodiment 3

Figure 4:
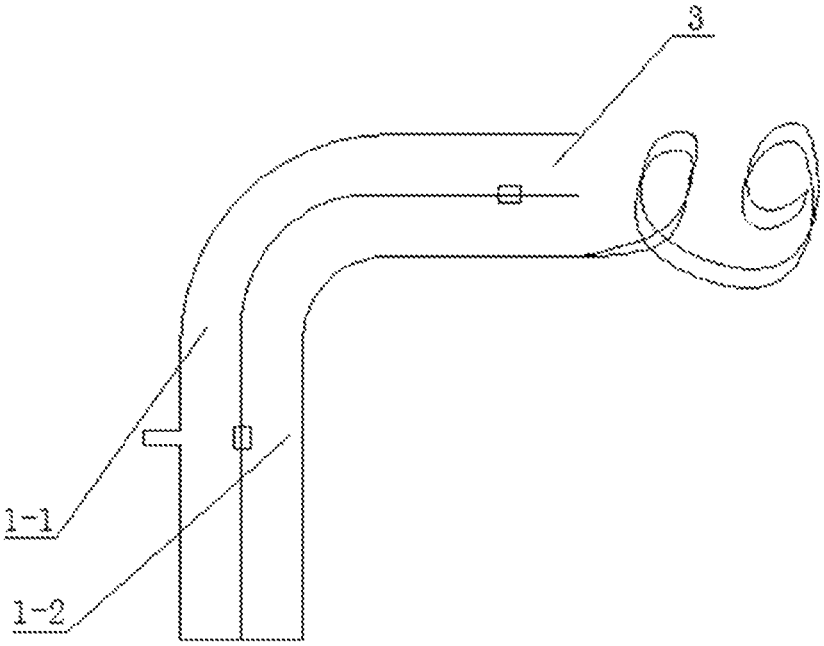
FIG. 4 shows a third schematic structural diagram of the present invention.

A third physiotherapy instrument for human body facet joint inflammation is as shown in FIG. 4. An L-shaped therapy cavity 1 includes a first housing 1-1 and a second housing 1-2 forming an L shape. The first housing 1-1 and the second housing 1-2 are arranged front and back. The rest of the structure is the same as that in Embodiment 1 or 2.

Embodiment 4

Figure 5:
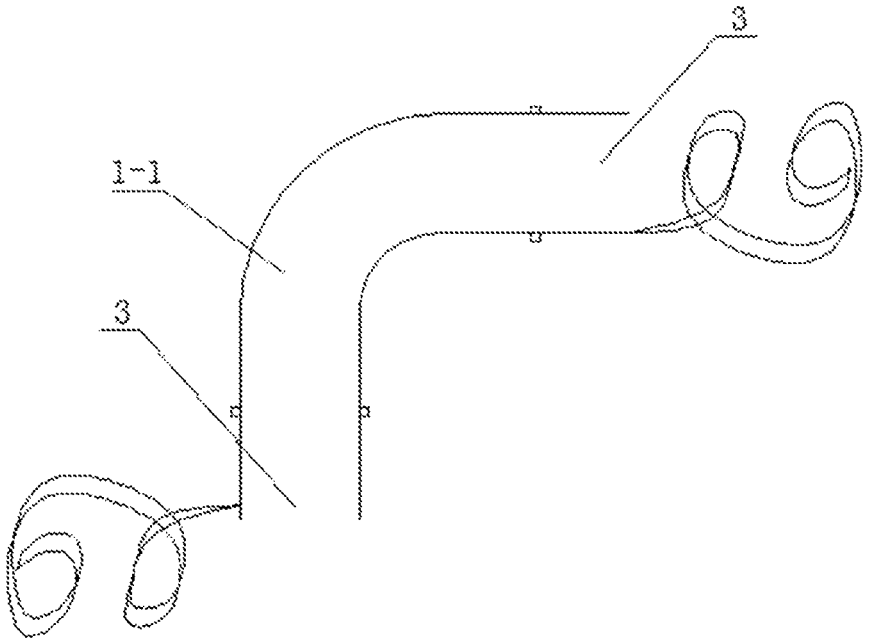
FIG. 5 shows a fourth schematic structural diagram of the present invention.

A fourth physiotherapy instrument for human body facet joint inflammation is as shown in FIG. 5. A therapy cavity 1 is provided with two openings 3 for a limb to enter and leave, which are located at two ends of the L-shaped therapy cavity 1, respectively. The rest of the structure is the same as that in Embodiment 1 or 2 or 3.

Embodiment 5

Figure 6:
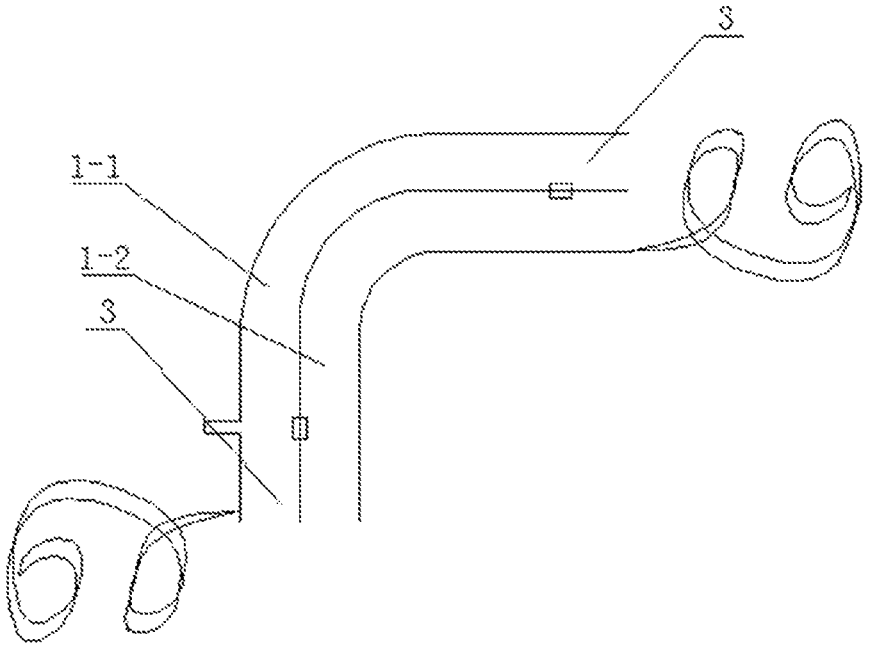
FIG. 6 shows a fifth schematic structural diagram of the present invention.

A fifth physiotherapy instrument for human body facet joint inflammation is as shown in FIG. 6. A therapy cavity 1 is provided with two openings 3 for a limb to enter and leave, which are located at two ends of the L-shaped therapy cavity 1, respectively. The L-shaped therapy cavity 1 includes a first housing 1-1 and a second housing 1-2 forming an L shape. The first housing 1-1 and the second housing 1-2 are arranged front and back. The rest of the structure is the same as that in Embodiment 1 or 2 or 3.

Embodiment 6

Figure 7:
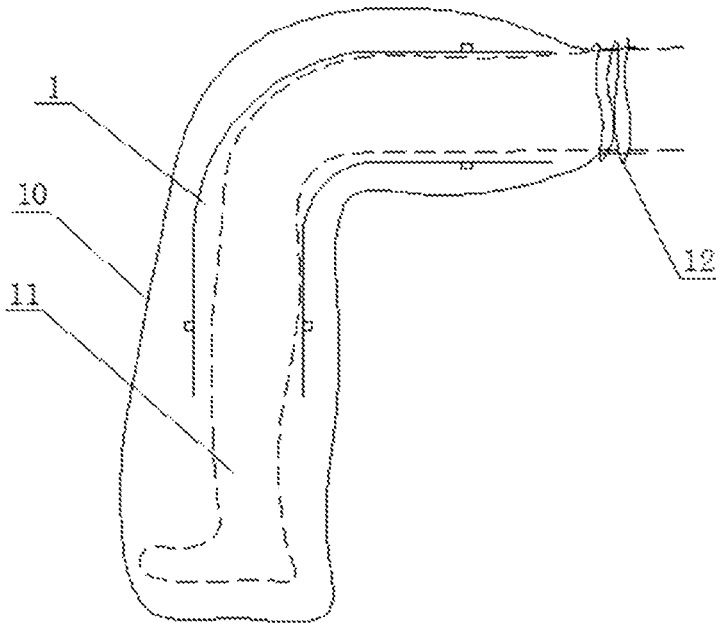
FIG. 7 shows a sixth schematic structural diagram of the present invention.

A sixth physiotherapy instrument for human body facet joint inflammation is as shown in FIG. 7, and further includes a first sealing bag 10 with one open end. An L-shaped therapy cavity 1 is completely sleeved in the first sealing bag 10. The open end of the first sealing bag 10 is sealed and fixed to a limb 11 by means of a first fixing rope 12.

Embodiment 7

Figure 8:
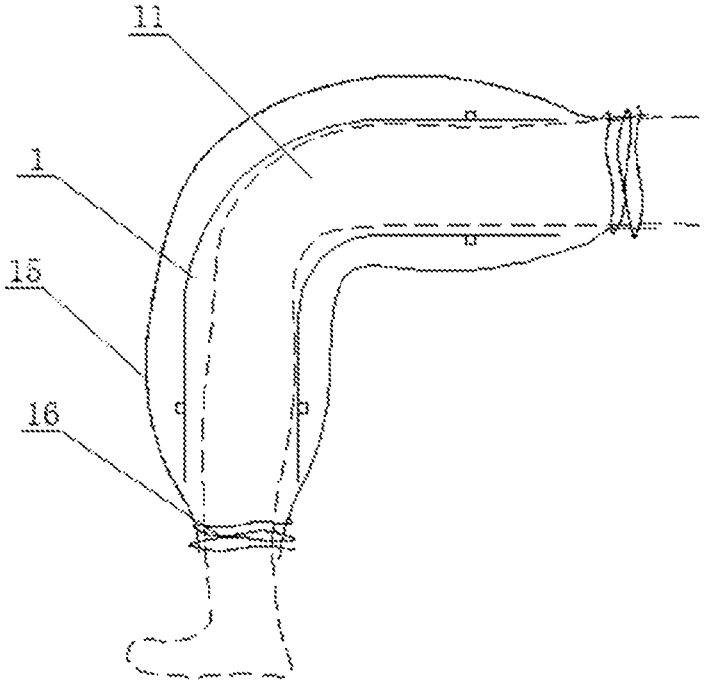
FIG. 8 shows a seventh schematic structural diagram of the present invention.

A seventh physiotherapy instrument for human body facet joint inflammation is as shown in FIG. 8, and further includes a second sealing bag 15 with two open ends. An L-shaped therapy cavity 1 is completely sleeved in the second sealing bag 15. The two open ends of the second sealing bag 15 are sealed and fixed to a limb 11 by means of a second fixing rope 16.

Embodiment 8

Figure 9:
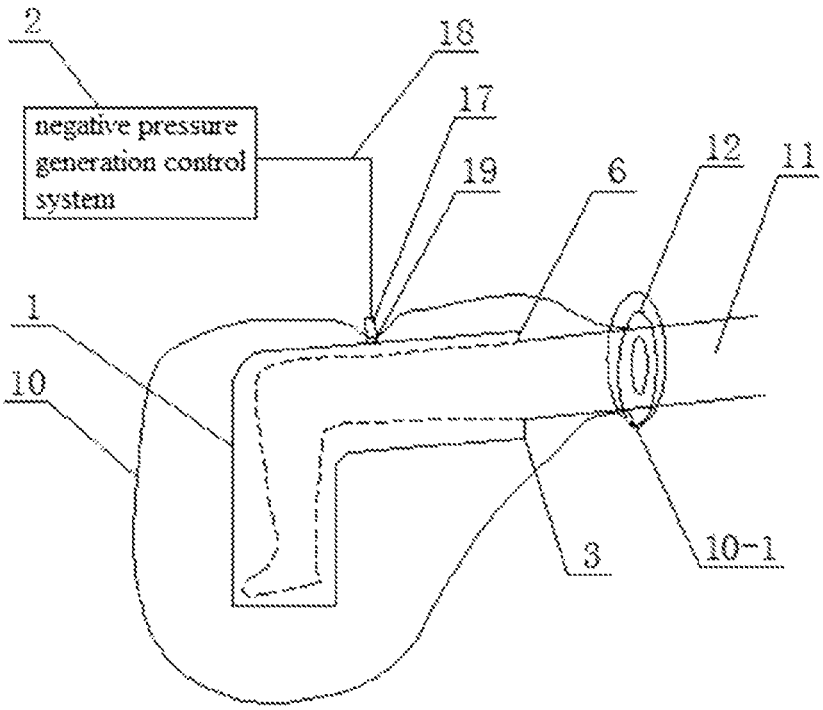
FIG. 9 shows an eighth schematic structural diagram of the present invention.
Figure 10:
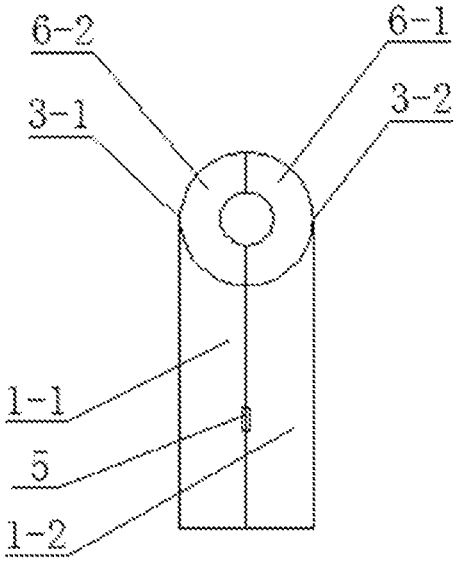
FIG. 10 shows a right view of a therapy cavity in FIG. 9.

An eighth physiotherapy instrument for human body facet joint inflammation is as shown in FIG. 9 and FIG. 10, and includes a rigid therapy cavity 1 and a negative pressure generation control system 2. The therapy cavity 1 is made of a transparent material and is L-shaped, to allow a partial thigh above a knee of a limb and a partial or entire shank (i.e., including a foot) below the knee to be put in after the knee bends, and allow a partial arm above an elbow of a limb and a partial or entire forearm (i.e., including a hand) below the elbow to be put in after the elbow bends. In this embodiment, the therapy cavity has one open end, and the foot or hand of the limb is entirely contained in the therapy cavity. The L-shaped therapy cavity 1 is composed of left and right parts fitted into a whole. The therapy cavity 1 is provided with an opening 3 for the limb to enter and leave. An easy-to-remove filling block 6 for filling a gap is provided between the opening 3 of the therapy cavity 1 and the limb. The filling block 6 is composed of a first filling block 6-1 and a second filling block 6-2.

The L-shaped therapy cavity 1 includes a first housing 1-1 and a second housing 1-2 forming an L shape. The first housing 1-1 and the second housing 1-2 are arranged left and right. The first housing 1-1 and the second housing 1-2 are fixed by a fastener 5. The first housing 1-1 and the second housing 1-2 may also be fixed by a buckle cord or the like instead of the fastener. In this embodiment, it is not necessary to provide a sealing strip at a junction between the first housing 1-1 and the second housing 1-2. The opening 3 for the limb to enter and leave is circular arc-shaped, and the circular arc-shaped opening 3 is formed by fitting a semi-arc-shaped first opening 3-1 on the first housing 1-1 with a semi-arc-shaped second opening 3-2 on the second housing 1-2.

After the limb is put in the therapy cavity 1, a cavity body is sleeved by a first sealing bag 10 with one open end, the first sealing bag 10 being made of a flexible polymer material. The therapy cavity 1 is completely sleeved in the first sealing bag 10. A first fixing rope 12 is provided between an opening 10-1 of the first sealing bag 10 and the limb 11 to fix and seal the opening 10-1 of the first sealing bag to the limb 11. The first sealing bag 10 is provided with an air hole or air nozzle 19. The therapy cavity is provided with an air nozzle 17 butt-jointed with the air hole or air nozzle 19 on the first sealing bag. After butt-joint, the therapy cavity is connected to an air passage 18, and a seal is formed at the butt-jointed portion. The other end of the air passage 18 is connected to the negative pressure generation control system 2 to form a negative pressure during operation.

Embodiment 9

Figure 11:
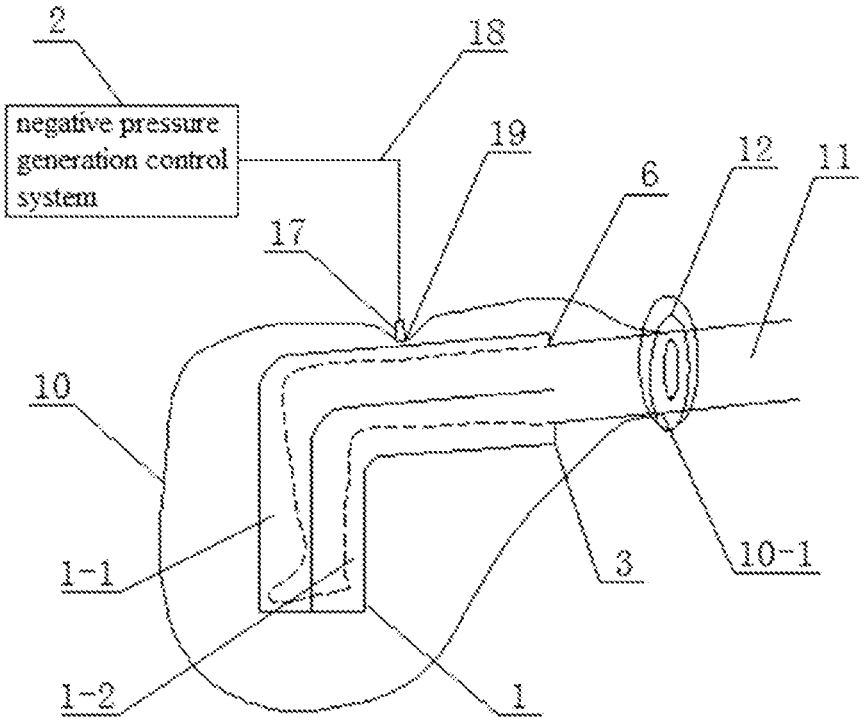
FIG. 11 shows a ninth schematic structural diagram of the present invention.
Figure 12:
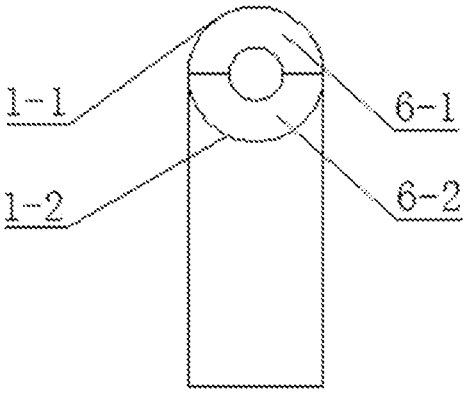
FIG. 12 shows a right view of a therapy cavity in FIG. 11.

A ninth physiotherapy instrument for human body facet joint inflammation is as shown in FIG. 11 and FIG. 12. An L-shaped therapy cavity 1 includes a first housing 1-1 and a second housing 1-2 forming an L shape. The first housing 1-1 and the second housing 1-2 are arranged front and back. In this embodiment, both the therapy cavity and the first sealing bag have one open end, and the rest of the structure is the same as that in Embodiment 8.

Embodiment 10

Figure 13:
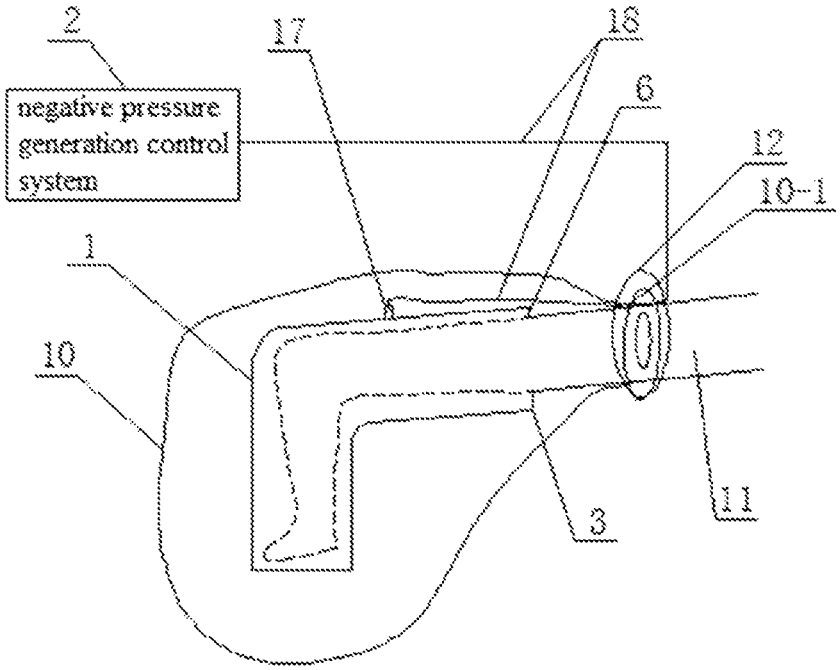
FIG. 13 shows a tenth schematic structural diagram of the present invention.
Figure 14:
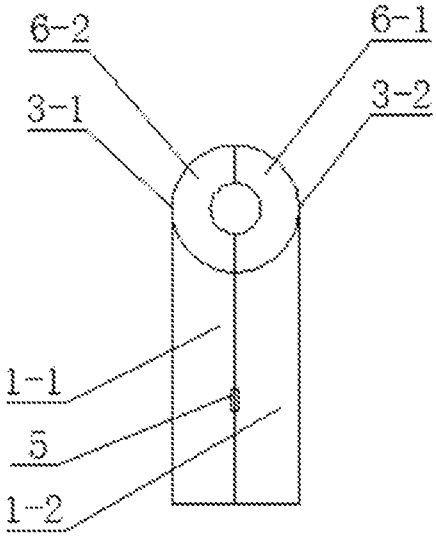
FIG. 14 shows a right view of a therapy cavity in FIG. 13.

A tenth physiotherapy instrument for human body facet joint inflammation is as shown in FIG. 13 and FIG. 14, and includes a rigid therapy cavity 1 and a negative pressure generation control system 2. The therapy cavity 1 is made of a transparent material and is L-shaped, to allow a partial thigh above a knee of a limb and a partial or entire shank (i.e., including a foot) below the knee to be put in after the knee bends, and allow a partial arm above an elbow of a limb and a partial or entire forearm (i.e., including a hand) below the elbow to be put in after the elbow bends. In this embodiment, the therapy cavity has one open end, and the foot or hand of the limb is entirely contained in the therapy cavity. The L-shaped therapy cavity 1 is composed of left and right parts fitted into a whole. The therapy cavity 1 is provided with an opening 3 for the limb to enter and leave. An easy-to-remove filling block 6 for filling a gap is provided between the opening 3 of the therapy cavity 1 and the limb. The filling block 6 is composed of a first filling block 6-1 and a second filling block 6-2.

The L-shaped therapy cavity 1 includes a first housing 1-1 and a second housing 1-2 forming an L shape. The first housing 1-1 and the second housing 1-2 are arranged left and right. The first housing 1-1 and the second housing 1-2 are fixed by a fastener 5. The first housing 1-1 and the second housing 1-2 may also be fixed by a buckle cord or the like instead of the fastener. In this embodiment, it is not necessary to provide a sealing strip at a junction between the first housing 1-1 and the second housing 1-2. The opening 3 for the limb to enter and leave is circular arc-shaped, and the circular arc-shaped opening 3 is formed by fitting a semi-arc-shaped first opening 3-1 on the first housing 1-1 with a semi-arc-shaped second opening 3-2 on the second housing 1-2.

After the limb is put in the therapy cavity 1, a cavity body is sleeved by a first sealing bag 10 with one open end, the first sealing bag 10 being made of a flexible polymer material. The therapy cavity 1 is completely sleeved in the first sealing bag 10. A first fixing rope 12 is provided between an opening 10-1 of the first sealing bag 10 and the limb 11 to fix and seal the opening 10-1 of the first sealing bag to the limb 11. The therapy cavity is provided with an air nozzle 17 connected to the other end of an air passage 18. The other end of the air passage 18 stretches out of the opening 10-1 of the first sealing bag 10 and then is connected to the negative pressure generation control system 2. The first sealing bag 10 is not provided with an air hole or air nozzle. The therapy cavity 1 is completely sleeved in the first sealing bag 10. A first fixing rope 12 is provided between an opening 10-1 of the first sealing bag 10 and the limb 11 to fix and seal the opening 10-1 of the first sealing bag to the limb 11 to form a negative pressure during operation.

Embodiment 11

Figure 15:
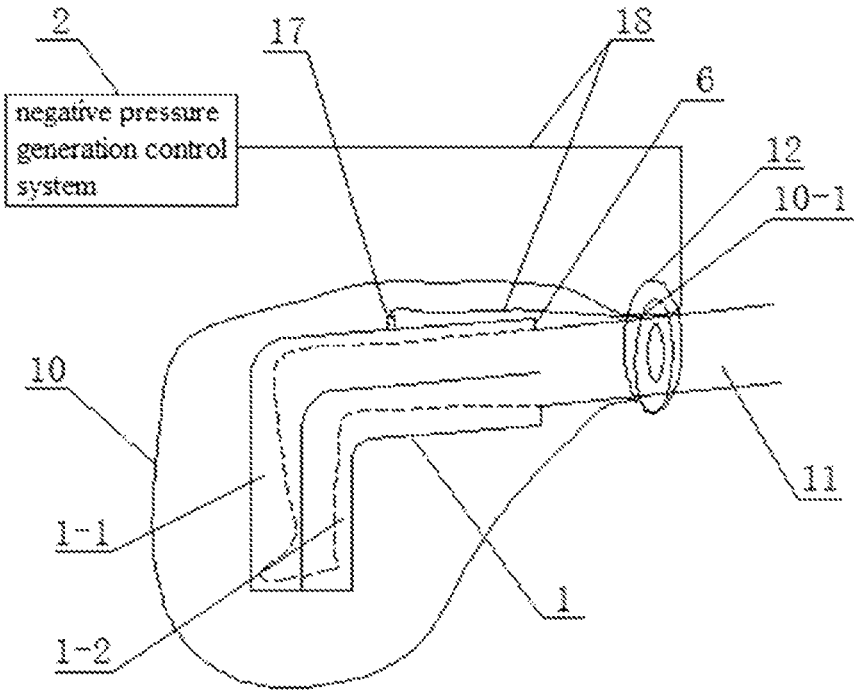
FIG. 15 shows an eleventh schematic structural diagram of the present invention.
Figure 16:
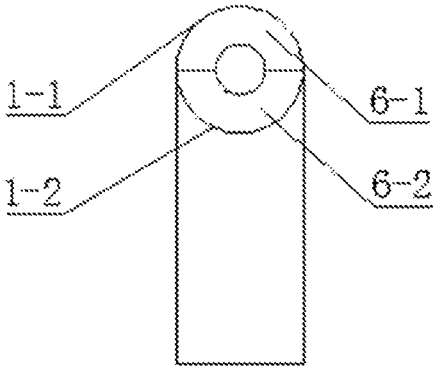
FIG. 16 shows a right view of a therapy cavity in FIG. 15.

An eleventh physiotherapy instrument for human body facet joint inflammation is as shown in FIG. 15 and FIG. 16. An L-shaped therapy cavity 1 includes a first housing 1-1 and a second housing 1-2 forming an L shape. The first housing 1-1 and the second housing 1-2 are arranged front and back. The therapy cavity has one open end, and the rest of the structure is the same as that in Embodiment 10.

Embodiment 12

Figure 17:
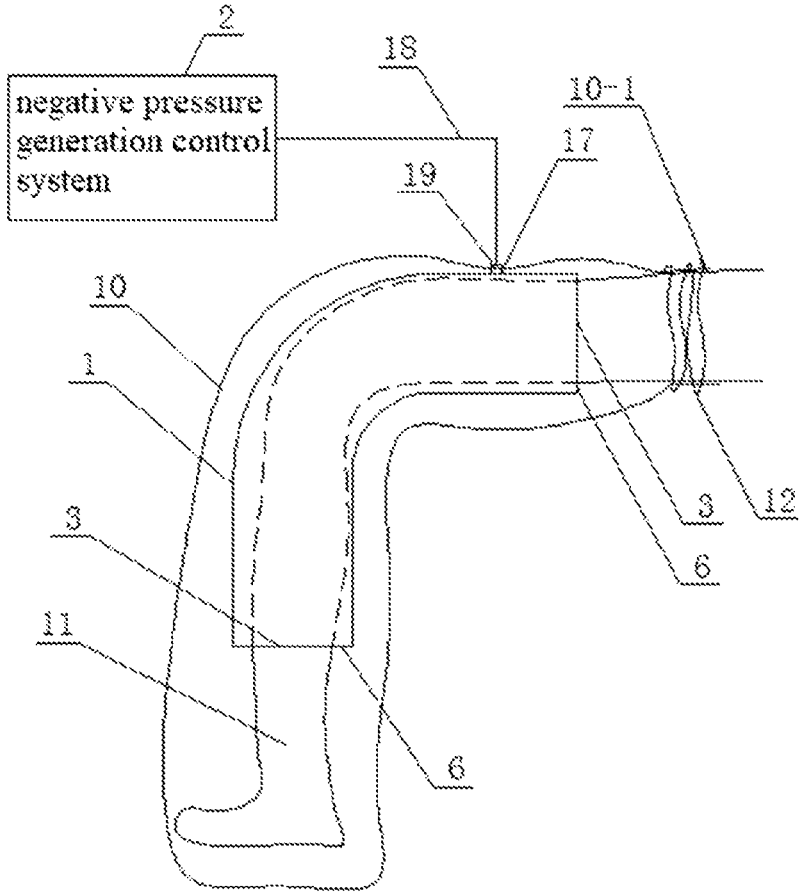
FIG. 17 shows a twelfth schematic structural diagram of the present invention.
Figure 18:
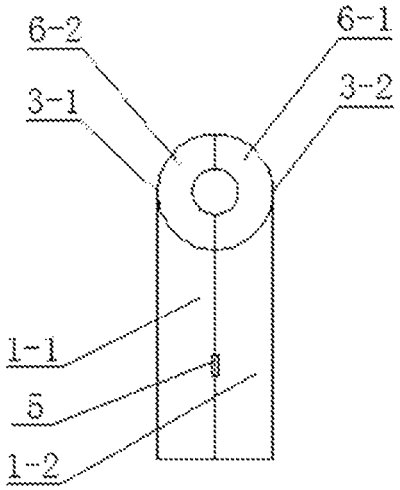
FIG. 18 shows a right view of a therapy cavity in FIG. 17.

A twelfth physiotherapy instrument for human body facet joint inflammation is as shown in FIG. 17 and FIG. 18. An L-shaped therapy cavity 1 includes a first housing 1-1 and a second housing 1-2 forming an L shape. The first housing 1-1 and the second housing 1-2 are arranged left and right. The therapy cavity 1 is provided with two open ends for a partial limb to put in, and the rest of the structure is the same as that in Embodiment 8.

Embodiment 13

Figure 19:
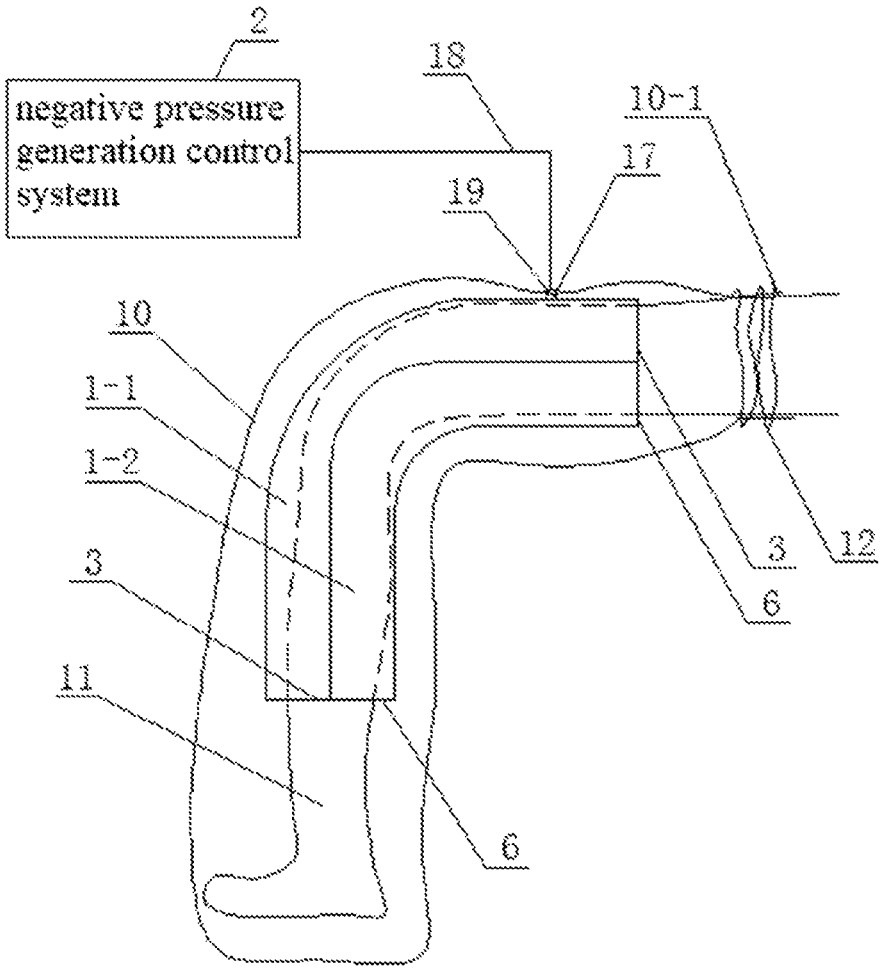
FIG. 19 shows a thirteenth schematic structural diagram of the present invention.
Figure 20:
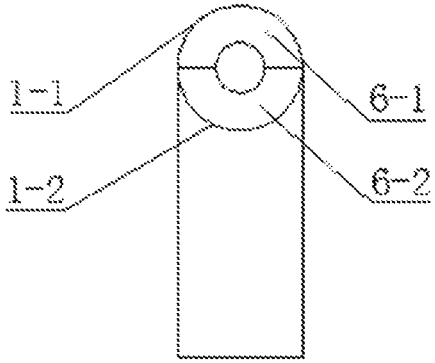
FIG. 20 shows a right view of a therapy cavity in FIG. 19.

A thirteenth physiotherapy instrument for human body facet joint inflammation is as shown in FIG. 19 and FIG. 20. An L-shaped therapy cavity 1 includes a first housing 1-1 and a second housing 1-2 forming an L shape. The first housing 1-1 and the second housing 1-2 are arranged front and back. The therapy cavity 1 is provided with two open ends for a partial limb to put in, and the rest of the structure is the same as that in Embodiment 9.

Embodiment 14

Figure 21:
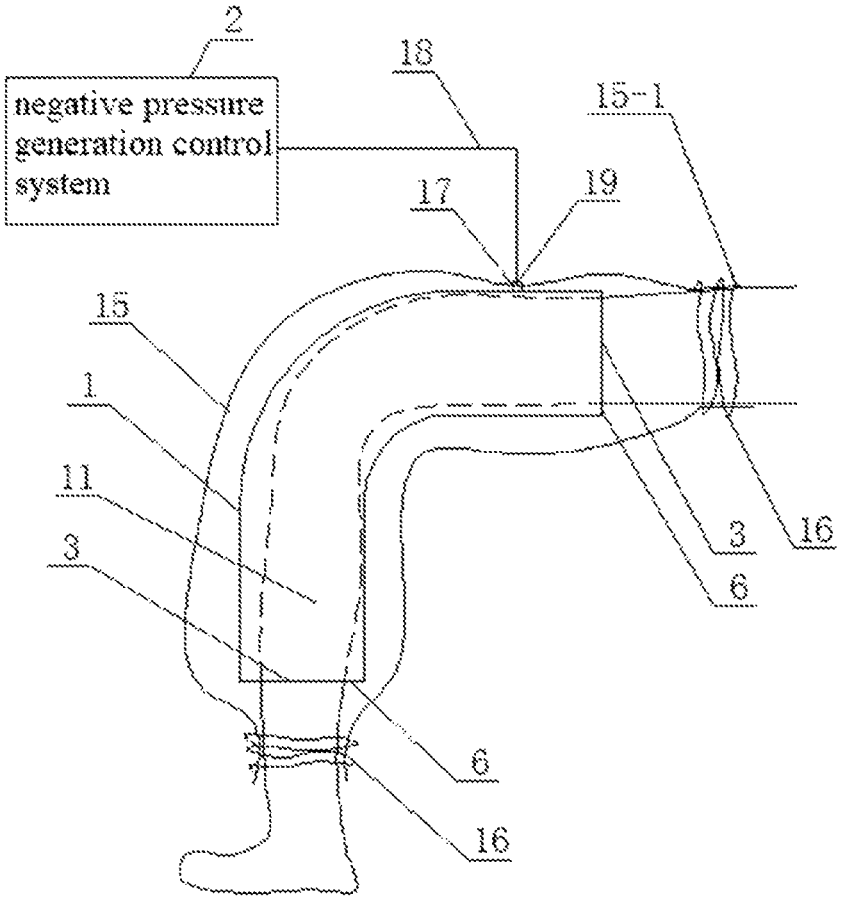
FIG. 21 shows a fourteenth schematic structural diagram of the present invention.
Figure 22:
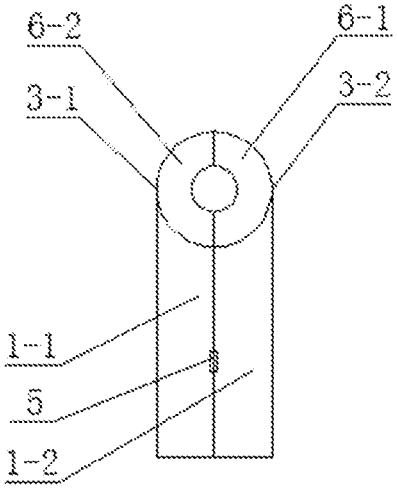
FIG. 22 shows a right view of a therapy cavity in FIG. 21.

A fourteenth physiotherapy instrument for human body facet joint inflammation is as shown in FIG. 21 and FIG. 22. An L-shaped therapy cavity 1 includes a first housing 1-1 and a second housing 1-2 forming an L shape. The first housing 1-1 and the second housing 1-2 are arranged left and right. In this embodiment, the therapy cavity has two open ends, a sealing bag is a second sealing bag 15 with two open ends, openings 15-1 at two ends of the sealing bag are fixed and sealed to two ends of a limb 11 by a second fixing rope 16 respectively, and the rest of the structure is the same as that in Embodiment 12.

Embodiment 15

Figure 23:
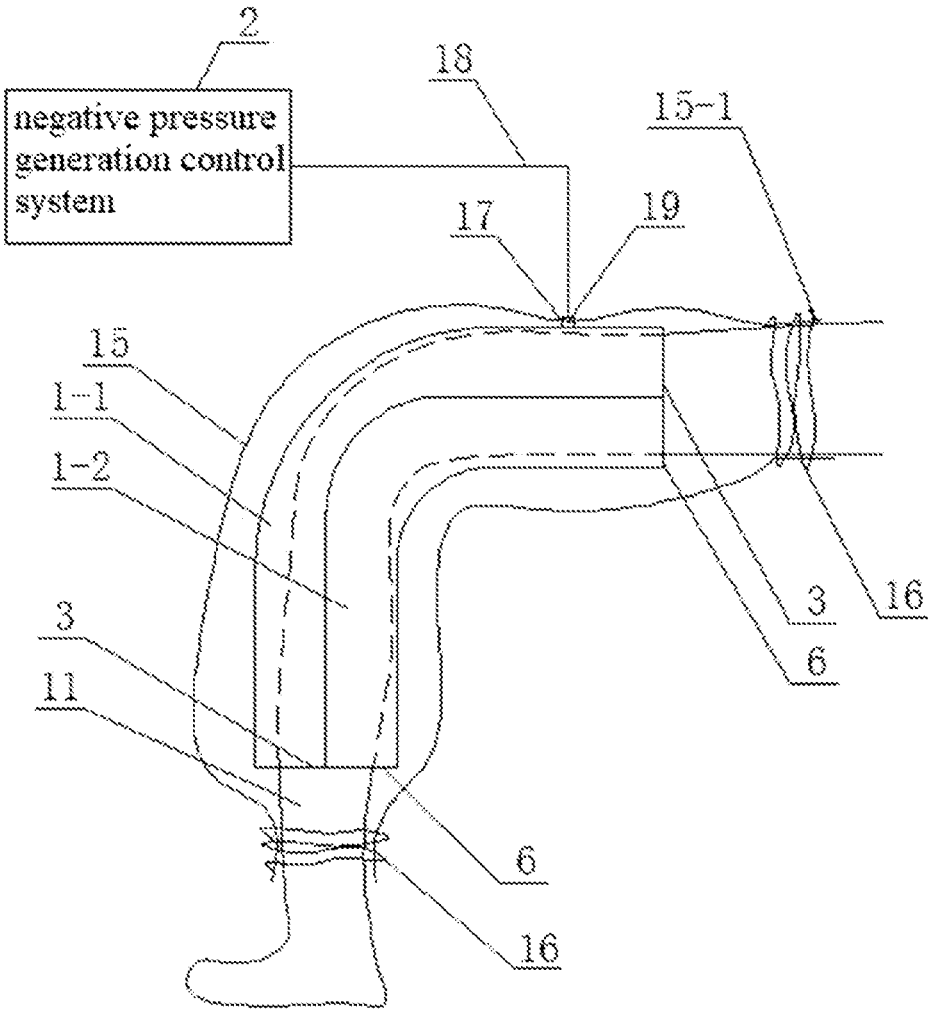
FIG. 23 shows a fifteenth schematic structural diagram of the present invention.
Figure 24:
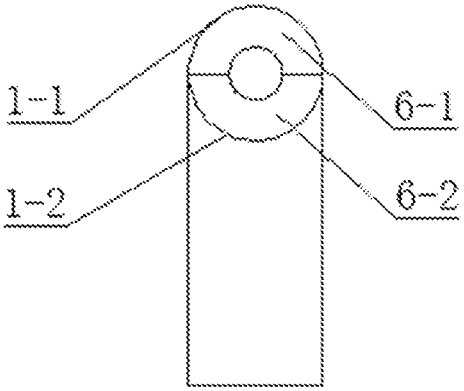
FIG. 24 shows a right view of a therapy cavity in FIG. 23.

A fifteenth physiotherapy instrument for human body facet joint inflammation is as shown in FIG. 23 and FIG. 24. An L-shaped therapy cavity 1 includes a first housing 1-1 and a second housing 1-2 forming an L shape. The first housing 1-1 and the second housing 1-2 are arranged front and back. In this embodiment, the therapy cavity has two open ends, a sealing bag is a second sealing bag 15 with two open ends, openings 15-1 at two ends of the sealing bag are fixed and sealed to a limb 11 by a second fixing rope 16, and the rest of the structure is the same as that in Embodiment 13.

Embodiment 16

Figure 25:
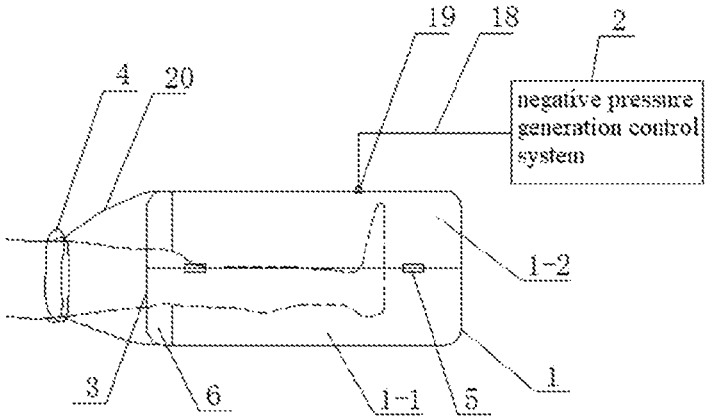
FIG. 25 shows a sixteenth schematic structural diagram of the present invention.

A sixteenth physiotherapy instrument for human body facet joint inflammation is as shown in FIG. 25, and includes a rigid therapy cavity 1, an air passage 18 and a positive-negative pressure generation control system 2. The positive-negative pressure generation control system 2 is connected to the therapy cavity 1 by means of the air passage 18. The therapy cavity 1 is provided with an air nozzle 19 butt-jointed with the air passage 18 of the positive-negative pressure generation control system 2. The rigid therapy cavity 1 is formed by butt-jointing two parts fitted with each other, namely a first therapy cavity 1-1 and a second therapy cavity 1-2. A seam is formed between the first therapy cavity 1-1 and the second therapy cavity 1-2. A gap at the butt joint is sealed by a sealing strip. The first therapy cavity 1-1 and the second therapy cavity 1-2 are fixed by a fastener 5. One end of the therapy cavity 1 is provided with a therapy cavity opening 3, and the therapy cavity opening is openable. The therapy cavity 1 and a limb are sealed by a filling block 6 and a sealing sleeve 20. The filling block 6 is configured to reduce the gap between the limb and the therapy cavity 1. The sealing sleeve 20 is made of an airtight flexible polymer material. The sealing sleeve 20 is seamless and internally hollow. The sealing sleeve 20 has two open ends. The limb is allowed to stretch in or out of the internal hollow. One end of the sealing sleeve 20 is connected to the limb by means of a winding tape 4, and the other end is connected to the therapy cavity opening 3.

During operation, the seamless sealing sleeve (which is hollow-shaped like an armband or a kneecap) made of a polymer material is integrally sleeved over a limb, and then the therapy cavity is wrapped outside the limb (upper limb or lower limb) needing to be treated. Meanwhile, according to the size of a gap between the limb and the therapy cavity opening, the filling block that is easily replaceable and has a suitable size is used for filling to reduce the gap. The filling block is usually formed by two semicircular rings fitted around the limb to make the sealing more effective. A sealing strip is provided at a seam of various components of the therapy cavity. After installation is completed, various components of the therapy cavity are fixed by a buckle or a strap between the various components of the therapy cavity. Finally, one end of the sealing sleeve is sleeved into the therapy cavity opening while the other end is located on the limb. Thus, the outside atmosphere is isolated from the internal air of the therapy cavity to form a seal. In order to prevent the sealing sleeve from falling off under positive and negative pressures, the sealing sleeve may be fixed to the limb and the therapy cavity by the strap at two ends of the sealing sleeve. In order to ensure a better sealing effect, the sealing sleeve is made of an airtight polymer material having certain elasticity. After the sealing sleeve is connected to the therapy cavity, in order to ensure that the sealing sleeve is firm and does not fall off during operation, the sealing sleeve is fixed to the limb and the opening of the therapy cavity by a fixing rope or a strap.

Embodiment 17

Figure 26:
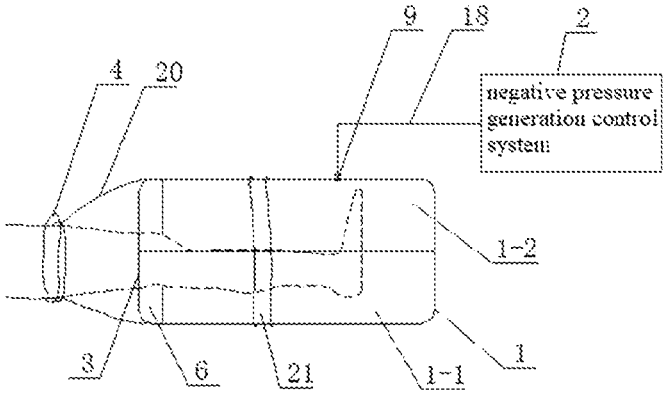
FIG. 26 shows a seventeenth schematic structural diagram of the present invention.

A seventeenth physiotherapy instrument for human body facet joint inflammation is as shown in FIG. 26. A first therapy cavity 1-1 and a second therapy cavity 1-2 are fixed by means of a fixing tape 21. The rest of the structure is the same as that in Embodiment 16.

Embodiment 18

Figure 27:
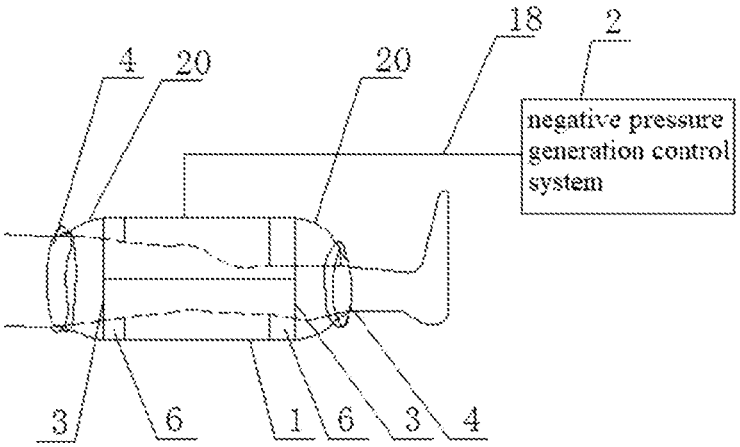
FIG. 27 shows an eighteenth schematic structural diagram of the present invention.

An eighteenth physiotherapy instrument for human body facet joint inflammation is as shown in FIG. 27. A therapy cavity 1 is straight cylindrical. The therapy cavity has two openings 3 located at two ends of the therapy cavity 1 respectively. There are two sealing sleeves 20, connected to two ends of the therapy cavity 1 respectively and fixed to a limb by means of a winding tape 4. The rest of the structure is the same as that in Embodiment 16.

Embodiment 19

Figure 28:
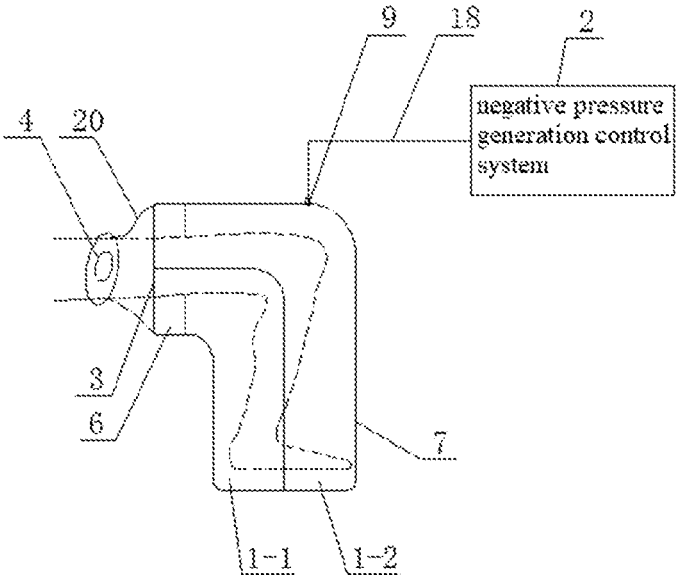
FIG. 28 shows a nineteenth schematic structural diagram of the present invention.

A nineteenth physiotherapy instrument for human body facet joint inflammation is as shown in FIG. 28. A therapy cavity 1 is L-shaped. A first therapy cavity 1-1, a second therapy cavity 1-2 and a seam 2 are all L-shaped. The therapy cavity has one opening 3 located at an upper end of the L-shaped therapy cavity 1. The rest of the structure is the same as that in Embodiment 16.

Embodiment 20

Figure 29:
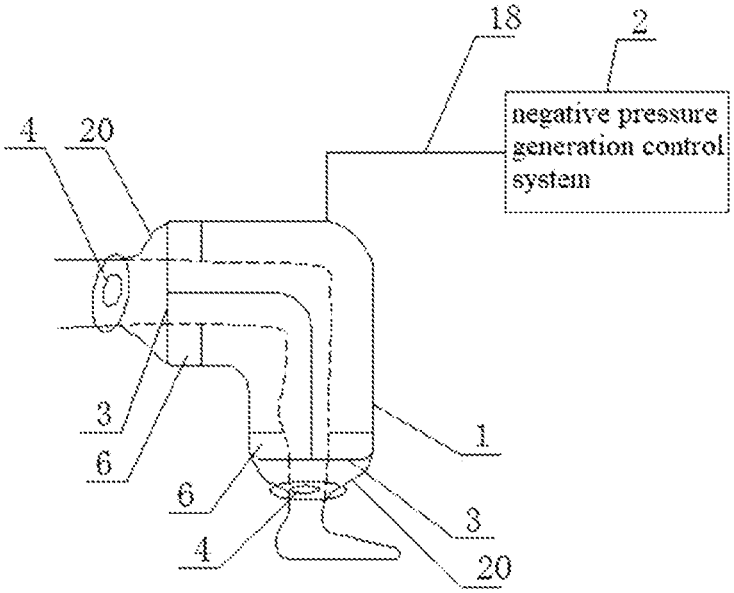
FIG. 29 shows a twentieth schematic structural diagram of the present invention.

A twentieth physiotherapy instrument for human body facet joint inflammation is as shown in FIG. 29. A therapy cavity 1 is L-shaped. The therapy cavity has two openings 3 located at upper and lower ends of the L-shaped therapy cavity 1 respectively. There are two sealing sleeves 20, connected to two ends of the therapy cavity 1 respectively and fixed to a limb by means of a winding tape 4. The rest of the structure is the same as that in Embodiment 19.

Embodiment 21

Figure 30:
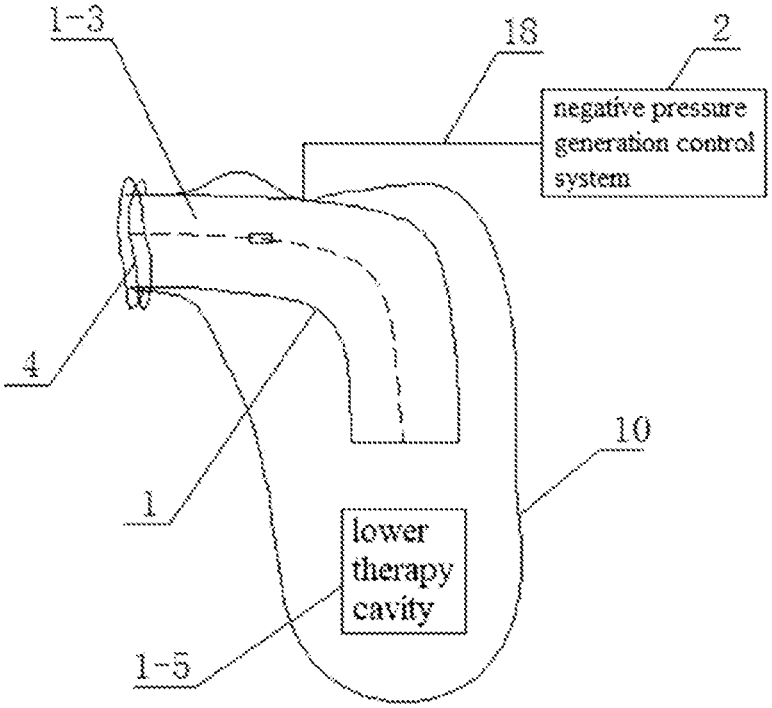
FIG. 30 shows a twenty-first schematic structural diagram of the present invention.

A twenty-first physiotherapy instrument for human body facet joint inflammation is as shown in FIG. 30. A therapy cavity 1 includes an upper therapy cavity 1-3 and a lower therapy cavity 1-5. A gap is formed between a lower end of the upper therapy cavity 1-3 and an upper end of the lower therapy cavity 1-5. The upper therapy cavity 1-3 is composed of two parts fitted with each other, and the lower therapy cavity 1-5 is formed by a whole alone. The upper therapy cavity is near the thigh or near a shoulder of an upper limb, and the lower therapy cavity is near the foot or near a hand of the upper limb. The therapy cavity 1 is completely sleeved in a first sealing bag 10. The first sealing bag 10 is sealed and fixed to a limb by means of a winding tape 4. The therapy cavity 1 is connected to a negative pressure generation control system 2 by means of an air passage 18.

Embodiment 22

Figure 31:
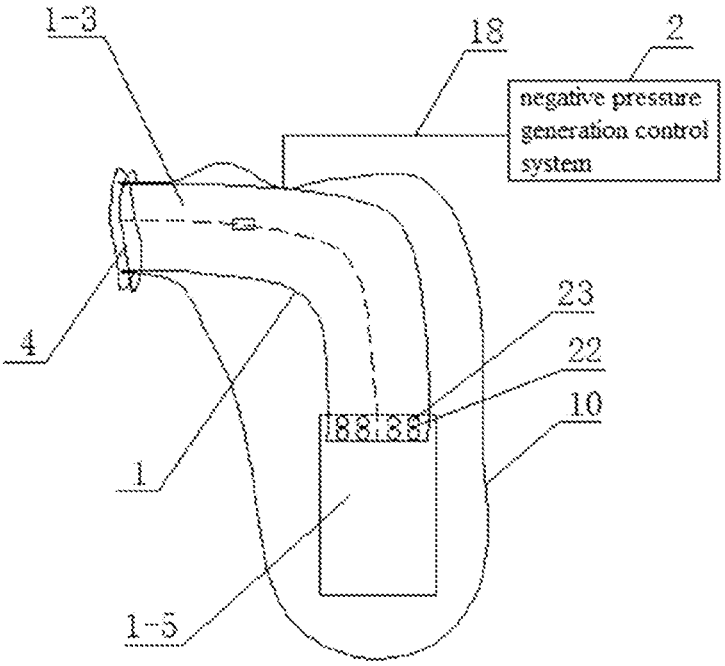
FIG. 31 shows a twenty-second schematic structural diagram of the present invention.

A twenty-second physiotherapy instrument for human body facet joint inflammation is as shown in FIG. 31. A therapy cavity 1 includes an upper therapy cavity 1-3 and a lower therapy cavity 1-5. The upper therapy cavity 1-3 is composed of two parts fitted with each other, and the lower therapy cavity 1-5 is formed by a whole alone. A lower end of the upper therapy cavity 1-3 and an upper end of the lower therapy cavity 1-5 are butt-jointed and partially overlapped, and overlapped portions are provided with corresponding pin holes 22 and connected by means of a pin 23. The rest is the same as that in Embodiment 21.

Embodiment 23

Figure 32:
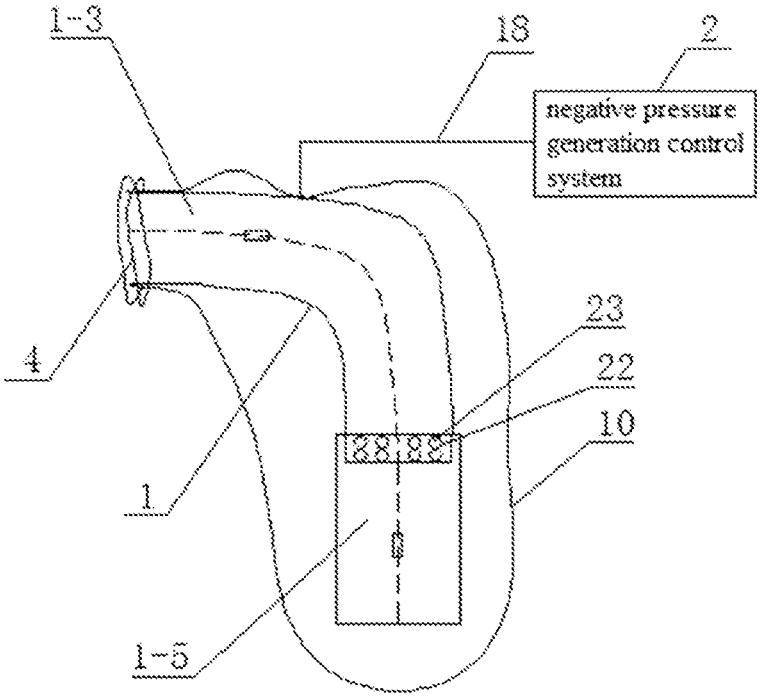
FIG. 32 shows a twenty-third schematic structural diagram of the present invention.

A twenty-third physiotherapy instrument for human body facet joint inflammation is as shown in FIG. 32. A lower therapy cavity 1-5 is composed of two parts fitted with each other. The rest is the same as that in Embodiment 22.

Embodiment 24

Figure 33:
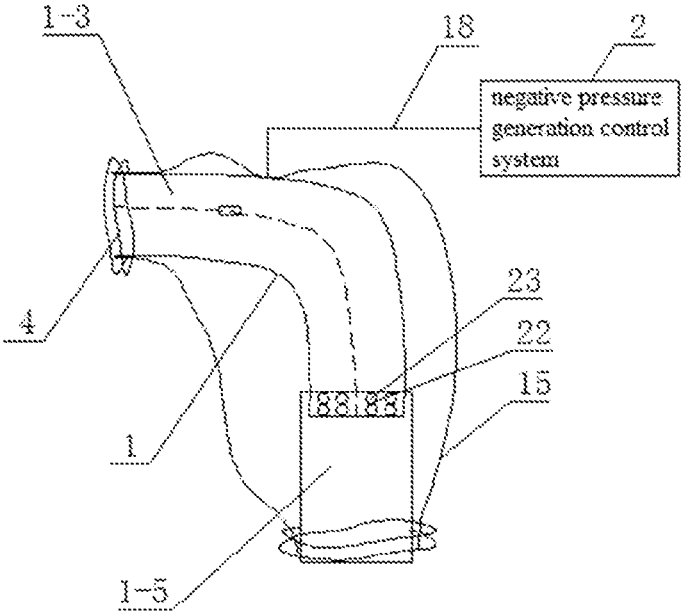
FIG. 33 shows a twenty-fourth schematic structural diagram of the present invention.

A twenty-fourth physiotherapy instrument for human body facet joint inflammation is as shown in FIG. 33. A second sealing bag 15 has two open ends. One of the two open ends of the second sealing bag 15 is fixed and sealed with a limb by means of a winding tape 4, and the other end is fixed to a lower therapy cavity 1-5 by means of the winding tape 4. The rest is the same as that in Embodiment 22.

Embodiment 25

Figure 34:
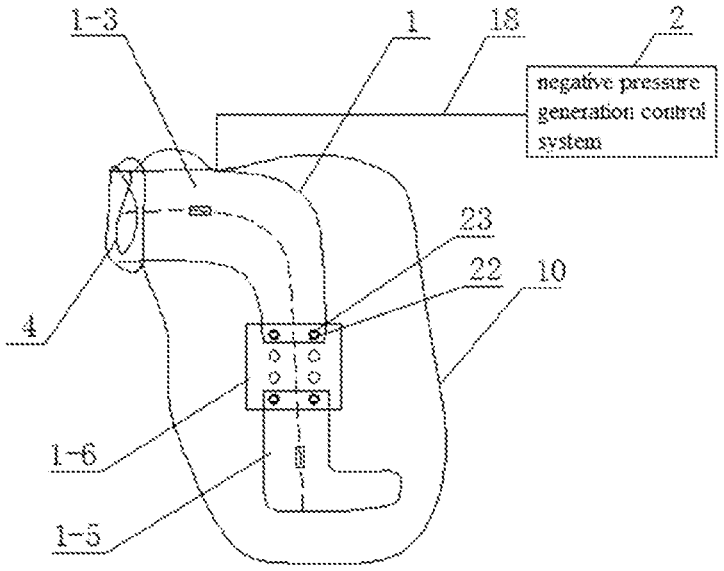
FIG. 34 shows a twenty-fifth schematic structural diagram of the present invention.

A twenty-fifth physiotherapy instrument for human body facet joint inflammation is as shown in FIG. 34. A therapy cavity 1 includes an upper therapy cavity 1-3, an intermediate therapy cavity 1-6 and a lower therapy cavity 1-5. An upper end of the intermediate therapy cavity 1-6 and the upper therapy cavity 1-3 are butt-jointed and partially overlapped, a lower end of the intermediate therapy cavity 1-6 and the lower therapy cavity 1-5 are butt-jointed and partially overlapped, and overlapped portions are provided with corresponding pin holes 22 and connected by means of pins 23. The rest is the same as that in Embodiment 23.

Embodiment 26

Figure 35:
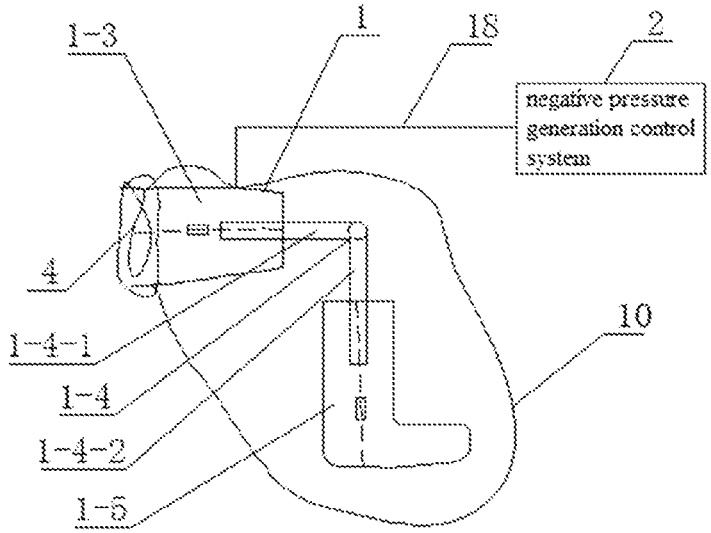
FIG. 35 shows a twenty-sixth schematic structural diagram of the present invention.

A twenty-sixth physiotherapy instrument for human body facet joint inflammation is as shown in FIG. 35. A therapy cavity 1 includes an upper therapy cavity 1-3 and a lower therapy cavity 1-5. Each of the upper therapy cavity 1-3 and the lower therapy cavity 1-5 is a split structure, formed by connecting two half parts fitted with each other. The upper therapy cavity 1-3 and the lower therapy cavity 1-5 are connected by means of two connecting frames 1-4. The two connecting frames 1-4 are located on left and right sides of the therapy cavity 1. The connecting frames 1-4 each include a first connecting rod 1-4-1 and a second connecting rod 1-4-2. The upper therapy cavity 1-3, the first connecting rods 1-4-1, the second connecting rods 1-4-2, and the lower therapy cavity 1-5 are hinged sequentially. The therapy cavity 1 is completely sleeved in a first sealing bag 10. The first sealing bag 10 is sealed and fixed to a limb by means of a winding tape 4. The therapy cavity 1 is connected to a negative pressure generation control system 2 by means of an air passage 18.

Embodiment 27

Figure 36:
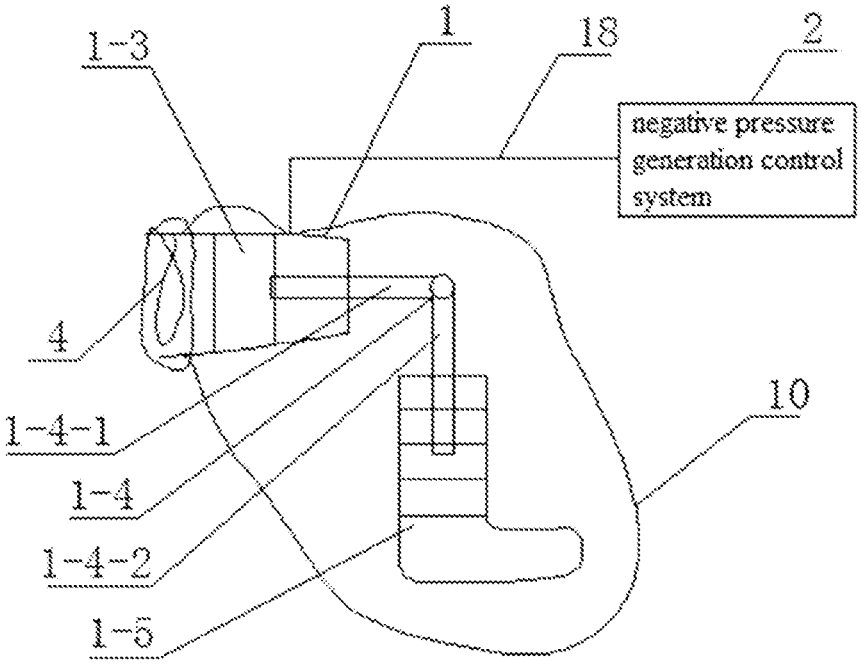
FIG. 36 shows a twenty-seventh schematic structural diagram of the present invention.

A twenty-seventh physiotherapy instrument for human body facet joint inflammation is as shown in FIG. 36. A therapy cavity 1 includes an upper therapy cavity 1-3 and a lower therapy cavity 1-5. Each of the upper therapy cavity 1-3 and the lower therapy cavity 1-5 is a split structure, composed of a plurality of sections. Each section of therapy cavity may be formed by an entire circle or may be formed by a circular ring obtained by combining two semicircles. The rest is the same as that in Embodiment 26.

What is claimed is:

1. A physiotherapy instrument for human body facet joint inflammation, comprising:

a rigid therapy cavity, and a negative pressure generation control system connected to the rigid therapy cavity via an air passage, wherein the rigid therapy cavity is an L-shaped rigid therapy cavity, the L-shaped rigid therapy cavity includes a rigid bending portion having a fixed, rigid bending angle, configured for receiving a bent limb of a user that is bent at a knee joint or an elbow joint before being placed in the L-shaped rigid therapy cavity, wherein a partial thigh of the user above the knee joint and at least a partial shank below the knee joint of the bent limb are placed in the L-shaped rigid therapy cavity, with the knee joint being placed at the rigid bending portion having the fixed, rigid bending angle, or a partial arm of the user above the elbow joint and at least a partial forearm below the elbow joint of the bent limb are placed in the L-shaped rigid therapy cavity, with the elbow joint being placed at the rigid bending portion having the fixed, rigid bending angle, the L-shaped rigid therapy cavity includes at least one opening for fixing the bent limb with the rigid therapy cavity by a sealed connecting component around at least one of a thigh of the bent limb, a shank of the bent limb, or an arm of the bent limb, the L-shaped rigid therapy cavity comprises a plurality of rigid parts structurally fitted to engage with each other to form a hollow wall of the L-shaped rigid therapy cavity after the bent limb is received, and the fixed, rigid bending angle is at an angle to allow the knee joint or the elbow joint to be in contact with the rigid bending portion of the hollow wall under a negative pressure, to receive a mechanical force caused by the negative pressure, wherein the fixed, rigid bending angle is at the angle to avoid a relative motion or the mechanical force, caused by the negative pressure, between the hollow wall of a lower portion of the L-shaped rigid therapy cavity and a corresponding part of the shank, the forearm, foot, and/or hand of the bent limb.

2. The physiotherapy instrument for human body facet joint inflammation according to claim 1, wherein the L-shaped rigid therapy cavity comprises a first housing and a second housing, wherein the first housing and the second housing form an L shape; the opening of the rigid therapy cavity is a circular arc-shaped opening, and the circular arc-shaped opening is formed by fitting a semi-arc-shaped first opening on the first housing with a semi-arc-shaped second opening on the second housing; and the rigid therapy cavity is provided with one open end or two open ends.

3. The physiotherapy instrument for human body facet joint inflammation according to claim 1, wherein the sealed connecting component comprises an airtight winding tape for winding sealing made of a polymer material, wherein air inside and air outside the rigid therapy cavity are isolated in a negative pressure therapy.

4. The physiotherapy instrument for human body facet joint inflammation according to claim 1, wherein the sealed connecting component comprises a sealing bag with one open end, the L-shaped rigid therapy cavity is completely sleeved in the sealing bag, and the open end of the sealing bag is sealed and fixed to the limb.

5. The physiotherapy instrument for human body facet joint inflammation according to claim 1, wherein the sealed connecting component comprises a sealing bag with two open ends, the L-shaped rigid therapy cavity is completely sleeved in the sealing bag, and the two open ends of the sealing bag are sealed and fixed to the limb.

6. The physiotherapy instrument for human body facet joint inflammation according to claim 4, wherein the sealing bag is provided with an air hole or an air nozzle that is connected to a first end of the air passage of the negative pressure generation system with a seal formed at a junction, and a second end of the air passage is connected to the negative pressure generation control system.

7. The physiotherapy instrument for human body facet joint inflammation according to claim 4, wherein the sealing bag is made of an airtight polymer material.

8. The physiotherapy instrument for human body facet joint inflammation according to claim 1, wherein the sealed connecting component is sealed by a sealing tape made of an elastic polymer material, and two ends of the sealing tape are connected and closed by a sealing zipper to form a sealed sleeve seal, wherein air inside and air outside the rigid therapy cavity are isolated in a negative pressure therapy.

9. The physiotherapy instrument for human body facet joint inflammation according to claim 1, wherein the rigid therapy cavity is formed by a butt-jointing at least two parts fitted with each other, the rigid therapy cavity is provided with a rigid therapy cavity opening, and the opening of the rigid therapy cavity is openable; and the sealed connecting component comprises a sealing sleeve, wherein the sealing sleeve is seamless and internally hollow and comprises two open ends, the sealing sleeve is configured for entering and leaving of the limb, a first end of the sealing sleeve is connected to the limb of a human body by a strap, and a second end of the sealing sleeve is connected to the opening of the rigid therapy cavity.

10. The physiotherapy instrument for human body facet joint inflammation according to claim 1, wherein the rigid therapy cavity comprises an upper rigid therapy cavity and a lower rigid therapy cavity, a lower end of the upper rigid therapy cavity and an upper end of the lower rigid therapy cavity are butt-jointed and partially overlapped, and overlapped portions are provided with corresponding pin holes and connected by a pin.

11. The physiotherapy instrument for human body facet joint inflammation according to claim 1, wherein the rigid therapy cavity comprises an upper rigid therapy cavity, an intermediate rigid therapy cavity, and a lower rigid therapy cavity, an upper end of the intermediate rigid therapy cavity and a lower end of the upper rigid therapy cavity are butt-jointed and partially overlapped, and a lower end of the intermediate rigid therapy cavity and an upper end of the lower rigid therapy cavity are butt-jointed and partially overlapped, and overlapped portions are provided with corresponding pin holes and connected by pins.

12. The physiotherapy instrument for human body facet joint inflammation according to claim 1, wherein the rigid therapy cavity is provided with one open end or two open ends, gaps are provided between the plurality of rigid parts, a plurality of rows of pin holes are provided on the plurality of rigid parts, and the rigid therapy cavity is formed by butt-jointing the plurality of rigid parts; and the rigid therapy cavity is fixed and sealed to the limb by a sealing bag.

13. The physiotherapy instrument for human body facet joint inflammation according to claim 5, wherein the sealing bag is provided with an air hole or an air nozzle that is connected to a first end of the air passage of the negative pressure generation system with a seal formed at a junction, and a second end of the air passage is connected to the negative pressure generation control system.

14. The physiotherapy instrument for human body facet joint inflammation according to claim 5, wherein the sealing bag is made of an airtight polymer material.

15. The physiotherapy instrument for human body facet joint inflammation according to claim 4, wherein the rigid therapy cavity is an integrated rigid therapy cavity formed by the plurality of rigid parts, the integrated therapy cavity is provided with one open end or two open ends, gaps are provided between the plurality of rigid parts, a plurality of rows of pin holes are provided on the plurality of rigid parts, and the integrated rigid therapy cavity is formed by butt-jointing the plurality of rigid parts; and the integrated rigid therapy cavity is fixed and sealed to the limb by the sealing bag.

16. The physiotherapy instrument for human body facet joint inflammation according to claim 5, wherein the rigid therapy cavity is an integrated rigid therapy cavity formed by the plurality of rigid parts, the integrated therapy cavity is provided with two open ends, gaps are provided between the plurality of rigid parts, a plurality of rows of pin holes are provided on the plurality of rigid parts, and the integrated rigid therapy cavity is formed by butt-jointing the plurality of rigid parts; and the integrated rigid therapy cavity is fixed and sealed to the limb by the sealing bag.

17. The physiotherapy instrument for human body facet joint inflammation according to claim 1, wherein the plurality of rigid parts are butt-jointed and partially overlapped in an axial direction to form overlapped portions, a plurality of rows of pin holes are provided on the overlapped portions, and a plurality of pins are inserted into the plurality of pin holes in a radial direction.

* * * * *